US010105754B2

(12) United States Patent
Yokoyama et al.

(10) Patent No.: US 10,105,754 B2
(45) Date of Patent: Oct. 23, 2018

(54) INJECTION APPARATUS AND MOLDING MACHINE

(71) Applicant: TOSHIBA KIKAI KABUSHIKI KAISHA, Tokyo (JP)

(72) Inventors: Hiroshi Yokoyama, Kanagawa (JP); Shunsuke Takekawa, Kanagawa (JP)

(73) Assignee: TOSHIBA KIKAI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/422,639

(22) Filed: Feb. 2, 2017

(65) Prior Publication Data

US 2017/0282243 A1 Oct. 5, 2017

(30) Foreign Application Priority Data

Apr. 5, 2016 (JP) ..... 2016-075608

(51) Int. Cl.
*B22D 17/32* (2006.01)
*B22D 17/10* (2006.01)
*B22D 17/20* (2006.01)

(52) U.S. Cl.
CPC ..... *B22D 17/32* (2013.01); *B22D 17/10* (2013.01); *B22D 17/203* (2013.01)

(58) Field of Classification Search
CPC ..... B22D 17/10; B22D 17/20; B22D 17/203; B22D 17/32
USPC ..... 164/155.5, 303, 312, 314
See application file for complete search history.

(56) References Cited

U.S. PATENT DOCUMENTS

2001/0040019 A1* 11/2001 Tsuji ..... B22D 17/10 164/314
2005/0028961 A1 2/2005 Toyoshima et al.
2014/0353340 A1* 12/2014 Ikeda et al. ..... B22D 17/32 222/596
2016/0200022 A1* 7/2016 Takei et al. ..... B29C 45/82 264/328.1
2016/0279701 A1* 9/2016 Tomioka et al. .... B22D 17/203

FOREIGN PATENT DOCUMENTS

JP 2004-330267 11/2004

OTHER PUBLICATIONS

English Language Abstract and English Language Translation of JP 2004-330267 published Nov. 25, 2004.

* cited by examiner

*Primary Examiner* — Kevin P Kerns
(74) *Attorney, Agent, or Firm* — DLA Piper LLP US

(57) ABSTRACT

A flow rate control valve configuring a meter-out circuit of an injection cylinder is an overlap type where a first port starts to be opened by a spool passing through an overlapping range. The control device holds a characteristic table linking a command value of a control command to the flow rate control valve and a velocity of a plunger including also the movement of the plunger which occurs due to a gap flow even if the spool is located in the overlapping range. Further, the control device specifies the command value corresponding to the target velocity set by operation of the input device based on the characteristic table, performs open control based on this command value, then performs the feedback control for realizing the target velocity.

8 Claims, 14 Drawing Sheets

INJECTION APPARATUS AND MOLDING MACHINE

TECHNICAL FIELD

The present invention relates to an injection apparatus and molding machine. The molding machine is for example a die cast machine or injection molding machine.

BACKGROUND ART

As the injection apparatus, there is known an apparatus which drives a plunger for extruding a molding material into a mold by an injection cylinder (for example Patent Literature 1). The velocity of the injection cylinder (in other words, the injection velocity) is generally controlled by a meter-in circuit which controls the flow rate of a hydraulic fluid supplied to the injection cylinder and/or meter-out circuit which controls the flow rate of the hydraulic fluid discharged from the injection cylinder. The meter-in circuit or meter-out circuit has a flow rate control valve and is usually feedback-controlled based on the velocity of the plunger.

The injection velocity has a large influence upon the quality of the molded article, so is suitably set by taking various conditions into account. For example, in an initial stage of injection, the injection velocity is set to a relatively low injection velocity in order to suppress entrapment of air into the molding material. After that, the injection velocity is set to a relatively high injection velocity for the purpose of filling the molding material into the mold without a time lag relative to the solidification of the molding material.

CITATION LIST

Patent Literature

Patent Literature 1: Japanese Patent Publication No. 2004-330267A

SUMMARY OF INVENTION

Technical Problem

In recent years, in order to improve the quality of molded articles, more precise velocity control has been requested. Further, again, for improvement of the quality, various injection velocities (waveforms) are set. As a result, it is sometimes difficult to meet the demands for high precision velocity control. For example, at the time of start of injection, sometimes the injection velocity is set not to make the injection velocity speedily reach a low injection velocity, but to make it reach a low injection velocity with a relatively moderate velocity gradient. In such case, in the feedback control of the flow rate control valve as explained above, sometimes the actual injection velocity did not suitably track the set injection velocity.

Accordingly, an injection apparatus and molding machine capable of improving the trackability of the injection velocity at the time of start of injection is preferably provided.

Solution to Problem

An injection apparatus according to one aspect of the present invention includes an injection cylinder which can be connected to a plunger capable of sliding in a sleeve communicated with the inside of a mold; a flow rate control valve which configures a meter-in circuit or meter-out circuit of the injection cylinder; a sensor which detects at least one of the position or velocity of the plunger; an input device which accepts an operation of the user; and a control device which controls the flow rate control valve. The flow rate control valve is an overlap type where a valve body is positioned at a position in accordance with a command value of the input control command, a port is closed as it is at the time when the valve body is positioned in the predetermined overlapping range even if the valve body moves and the port starts to be opened by the valve body passing through the overlapping range. The control device includes a memory unit which holds characteristic information linking the command value of the control command to the flow rate control valve and the velocity of the plunger including also the movement of the plunger which is caused by a gap flow even if the valve body is positioned in the overlapping range, a target velocity setting part for setting the target velocity of the plunger based on operation of the input device, a command value setting part which sets the command value of the control command for open control of the flow rate control valve at the time of start of injection by specifying the command value of the control command to the flow rate control valve corresponding to the target velocity set by the target velocity setting part based on the characteristic information, an open control part which outputs a control command having a command value set by the command value setting part and performs open control, and a feedback control part which performs feedback control of the flow rate control valve so that the target velocity set by the target velocity setting part is realized based on the detection value of the sensor after the open control.

Preferably, the control device further includes an information updating part which updates the characteristic information based on the command value of the control command and the velocity detected by the sensor at the time when the control command is output to the flow rate control valve.

Preferably, the characteristic information is a table linking a predetermined plurality of command values and a plurality of velocities of the plunger. The control device further includes an update-use control part which, separately from the molding cycle, outputs the control commands of the predetermined plurality of command values in order. The information updating part updates the velocities linked with the predetermined plurality of command values in the table according to the velocity detected by the sensor at the time when the control commands having the predetermined plurality of command values are output in order from the update-use control part.

Preferably, the information updating part updates the characteristic information based on the command value of the control command and the velocity detected by the sensor at the time when this control command is output to the flow rate control valve in the molding cycle.

Preferably, the sensor is able to detect the position of the plunger. The control device includes a target position calculation part which calculates the target position of the plunger for each elapsed time based on the target velocity set by the target velocity setting part. The feedback control part calculates the command value for each elapsed time based on a sum of a value proportional to a deviation between the position of the plunger detected by the sensor at that time and the target position of the plunger at that time and the predetermined offset value and uses the last command value in the open control as the offset value.

Preferably, the injection apparatus further has a display device capable of displaying an image. The sensor can detect the position of the plunger. The command value setting part sets the command value of the control command for the open control with respect to the elapsed time from the start of injection. The open control part outputs the control command of the command value set by the command value setting part based on the elapsed time from the start of injection. The control device includes a display control part which makes the display device display a predetermined alert image at the time when a difference between the position of the plunger at the time of end of the open control which is calculated based on the target velocity set by the target velocity setting part and the position of the plunger detected by the sensor at the time of end of the open control exceeds a predetermined threshold value.

Preferably, The open control part and the feedback control part control the flow rate control valve so as to switch from the open control to the feedback control at the time when the velocity of the plunger reaches a constant level in a case where the target velocity of the plunger set by the target velocity setting part rises to the constant velocity from the start of injection, then the constant velocity is maintained.

A molding machine according to an aspect of the present invention includes the above injection apparatus.

Advantageous Effects of Invention

According to the above configuration, the trackability of the injection velocity at the time of start of injection can be improved.

DESCRIPTION OF EMBODIMENTS

<Schematic Configuration of Injection Apparatus>

Figure 1:
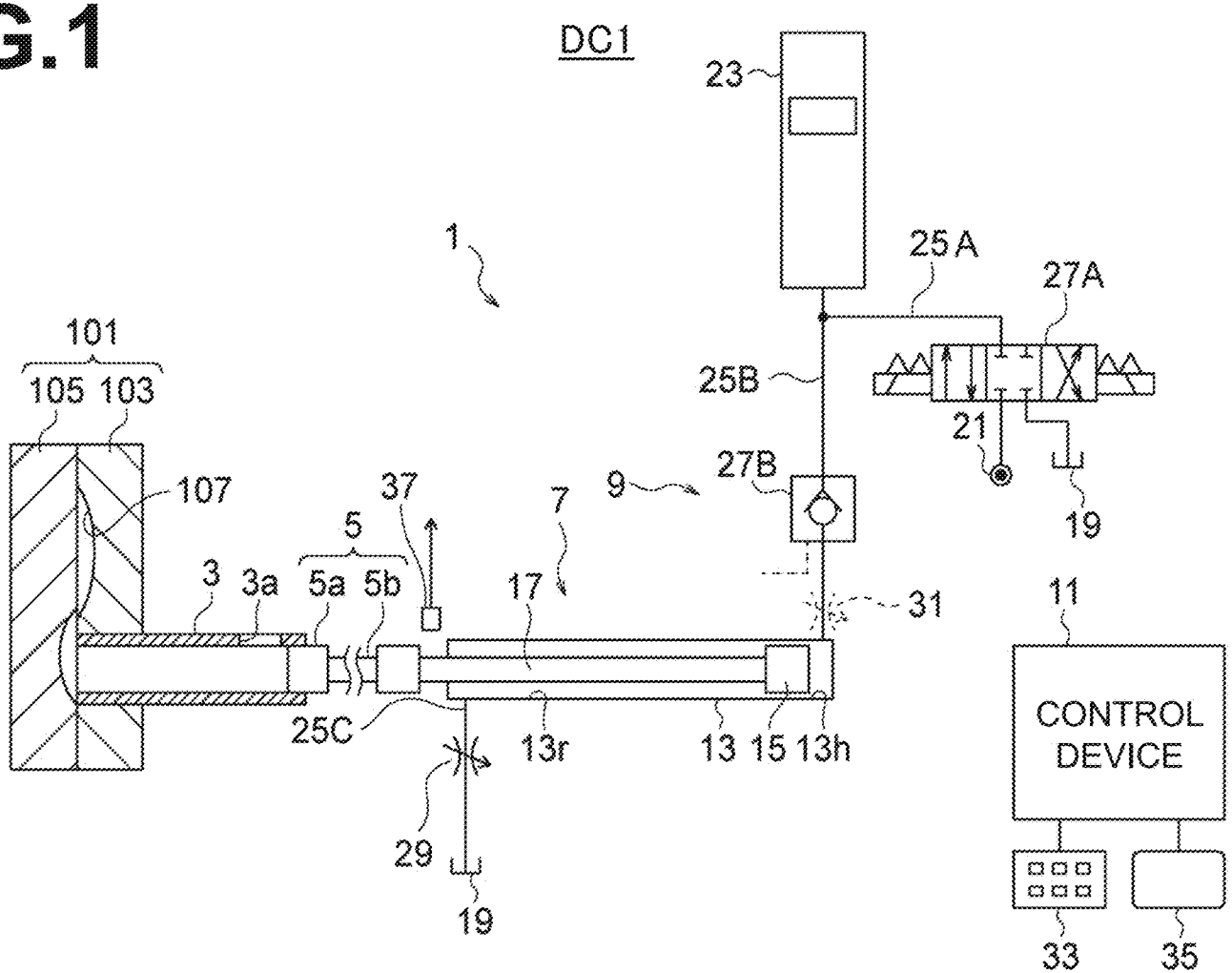
FIG. 1 is a schematic view showing a principal part of a die cast machine having an injection apparatus according to an embodiment of the present invention.

FIG. 1 is a schematic view showing the configuration of a principal part of a die cast machine DC1 having an injection apparatus 1 according to an embodiment of the present invention. Note that, in the following description, sometimes the leftward and rightward directions on the drawing sheet (forward and backward travel directions of the plunger 5 which will be explained later) will be referred to as the "forward" and "backward" directions.

The die cast machine DC1 is one for producing a die casting (molded article) by injecting molten metal (metal material in a molten state) as the molding material into a mold 101 (cavity 107) and making that molten metal solidify in the mold 101. The mold 101 for example includes a fixed mold 103 and a movable mold 105.

Specifically, the die cast machine DC1 for example has a not shown mold clamping device which opens/closes and clamps the mold 101, an injection apparatus 1 which injects molten metal to an internal portion of the clamped mold 101, a not shown ejection device which ejects the die casting from the fixed mold 103 or movable mold 105, and a control device which controls them. The configurations of the parts other than the injection apparatus 1 basically may be the same as various conventional configurations, and explanations are omitted.

The injection apparatus 1 for example has a sleeve 3 communicated with the cavity 107, a plunger 5 which ejects the molten metal in the sleeve 3 into the cavity 107, an injection cylinder 7 which drives the plunger 5, a hydraulic apparatus 9 for supplying hydraulic fluid to the injection cylinder 7, and a control device 11 which controls the hydraulic apparatus 9. Various conventional configurations can also be applied to the injection apparatus 1 except for the configuration of the control device 11 (operation from another viewpoint). The configuration of the injection apparatus 1 is for example as follows.

The sleeve 3 is for example a cylindrical member which is inserted in the fixed mold 103. The plunger 5 has a plunger tip 5*a* which can slide in the forward/backward direction in the sleeve 3 and a plunger rod 5*b* which is fixed to the plunger tip 5*a*. The molten metal is supplied into the sleeve 3 from a molten metal supplying hole 3*a* formed in the upper surface of the sleeve 3, then the plunger tip 5*a* slides (moves forward) in the sleeve 3 toward the cavity 107, whereby the molten metal is injected into the cavity 107.

The injection cylinder 7 for example has a cylinder part 13, an injection piston 15 which can slide inside the cylinder part 13, and a piston rod 17 which is fixed to the injection piston 15 and extends outward from the cylinder part 13.

The cylinder part 13 is for example a cylindrical body having an internal portion given a circular cross-sectional shape. Its diameter is constant in the longitudinal direction. The internal portion of the cylinder part 13 is partitioned by the injection piston 15 into a rod side chamber 13*r* on the side where the piston rod 17 extends outward and a head side chamber 13*h* on the opposite side to that. The hydraulic fluid is selectively supplied to the rod side chamber 13*r* and the head side chamber 13*h*, whereby the injection piston 15 slides in the forward/backward direction in the injection cylinder part 13*a*.

The injection cylinder 7 is arranged coaxially with respect to the plunger 5. Further, the piston rod 17 is connected through a coupling (notation is omitted) to the plunger 5. The cylinder part 13 is provided in a fixed manner with respect to a not shown mold clamping device or the like. Accordingly, by the movement of the injection piston 15 relative to the cylinder part 13, the plunger 5 moves forward or backward in the sleeve 3.

Note that, in the illustrated example, the injection cylinder 7 is configured as a single acting type (single barrel type) having only the injection piston 15 as the piston. However, the injection cylinder 7 may be configured as a so-called booster type as well. That is, although not particularly shown, the injection cylinder 7 may have a booster cylinder part which is communicated with the head side chamber 13*h* of the cylinder part 13 and a booster piston capable of sliding in the booster cylinder part. The booster piston has a larger pressure receiving area relative to the pressure receiving area for receiving the pressure from the head side chamber 13*h* on the opposite side to that. Due to this, a boosting action is exerted.

The hydraulic apparatus 9 for example has a tank 19 for storing the hydraulic fluid, a pump 21 capable of pumping out the hydraulic fluid in the tank 19, an accumulator 23 capable of discharging compressed hydraulic fluid, a plurality of passages (first passage 25A to third passage 25C) for connecting these and the injection cylinder 7 to each other, and a plurality of valves (first valve 27A, second valve 27B, and flow rate control valve 29) which control the flow of the hydraulic fluid in these plurality of passages. Note that, FIG. 1 shows tanks 19 at two positions as a matter of convenience for illustration. In actuality, they may be combined into one tank 19.

The tank 19 is for example an open tank and holds the hydraulic fluid under atmospheric pressure. The tank 19 supplies the hydraulic fluid through the pump 21 and accumulator 23 to the injection cylinder 7 and stores the hydraulic fluid discharged from the injection cylinder 7.

The pump 21 is driven by a not shown electric motor and pumps out the hydraulic fluid. The pump may be a suitable type such as a rotary pump, plunger pump, constant capacity pump, variable capacity pump, mono-directional pump, bidirectional (two-way) pump, or the like. Also, the electric motor for driving the pump 21 may be a suitable type such as a DC motor, AC motor, induction motor, synchronous motor, or servo motor. The pump 21 (electric motor) may be driven all the time during the operation of the die cast machine DC1 or may be driven according to need. The pump 21 for example contributes to the supply of the hydraulic fluid to the accumulator 23 (pressure accumulation of the accumulator 23) and the supply of the hydraulic fluid to the injection cylinder 7.

The accumulator 23 may be a suitable type. For example, it is a gravimetric type, spring type, gas pressure type (including air pressure type), cylinder type, or bladder type. In the illustrated example, the accumulator 23 is a cylinder type and has a cylinder part and a piston for partitioning the cylinder part to a liquid chamber and a gas chamber although notations are not particularly attached. The accumulator 23 stores the pressure by the supply of hydraulic fluid to the liquid chamber and can release that compressed relatively high pressure hydraulic fluid to the injection cylinder 7.

The first passage 25A connects the pump 21 and the accumulator 23 (liquid chamber thereof). Due to this, for example, the hydraulic fluid is supplied from the pump 21 to the accumulator 23 and pressure can be accumulated in the accumulator 23.

The second passage 25B connects the accumulator 23 (liquid chamber thereof) and the head side chamber 13*h*. Due to this, for example, the injection piston 15 can be moved forward by supplying the hydraulic fluid from the accumulator 23 to the head side chamber 13*h*.

The third passage 25C connects the rod side chamber 13*r* and the tank 19. Due to this, for example, along with the forward movement of the injection piston 15, the hydraulic fluid discharged from the rod side chamber 13*r* can be stored in the tank 19.

Note that, FIG. 1 illustrates a representative passage relating to the characteristic feature of the present embodiment among the passages provided in the hydraulic apparatus 9. In actuality, the hydraulic apparatus 9 has other not shown passages. For example, the hydraulic apparatus 9 has a passage for supplying hydraulic fluid from the pump 21 to the rod side chamber 13*r* in order to retract the injection piston 15.

The shown or not shown plurality of passages are for example configured by steel pipes, flexible hoses, or metal blocks. The plurality of passages may be suitably combined. For example, in the example in FIG. 1, portions of the first passage 25A and second passage 25B on the accumulator 23 side are combined.

The first valve 27A is provided in the first passage 25A and for example contributes to permission and prohibition of the supply of hydraulic fluid from the pump 21 to the accumulator 23. The first valve 27A, for example, is configured by a direction control valve. More specifically, for example, it is configured by a 4-port 3-position switching valve driven by a spring and electromagnet. The first valve 27A, for example, prohibits the flow between the accumulator 23 and the tank 19 and pump 21 at one position (for example neutral position). At another position, it permits the flow from the pump 21 to the accumulator 23 and prohibits the flow from the accumulator 23 to the tank 19. Further, at still another position, it prohibits the flow from the pump 21 to the accumulator 23 and permits the flow from the accumulator 23 to the tank 19.

The second valve 27B is provided in the second passage 25B and for example contributes to the permission and prohibition of the supply of hydraulic fluid from the accumulator 23 to the head side chamber 13*h*. The second valve 27B, for example, is configured by a pilot type check valve, permits the flow of the hydraulic fluid from the accumulator 23 to the head side chamber 13*h* and prohibits the flow in the opposite direction to that at the time when a pilot pressure is not introduced, and prohibits the two flows when the pilot pressure is introduced.

The flow rate control valve 29 is provided in the third passage 25C. For example, it contributes to the control of the flow rate of the hydraulic fluid from the rod side chamber 13*r* to the tank 19. By the control of the flow rate, the forward movement velocity of the injection piston 15 is controlled. That is, the flow rate control valve 29 configures a so-called meter-out circuit. The flow rate control valve 29, for example, is configured by a flow rate adjustment valve with pressure compensation capable of keeping the flow rate constant even if pressure fluctuation occurs. Further, the flow rate control valve 29 is for example configured by a servo valve which is used in a servo mechanism and can perform continuous modulation of the flow rate in accordance with the input signal.

Note that, in place of or addition to the meter-out circuit, a meter-in circuit may be provided. For example, between the accumulator 23 and the head side chamber 13*h*, a flow rate control valve 31 (shown by a dotted line) having the same configuration as that of the flow rate control valve 29 may be provided. In the following description, basically, sometimes only the flow rate control valve 29 will be referred to and the flow rate control valve 31 won't. In this case, however, the explanation for the flow rate control valve 29 corresponds to one for the flow rate control valve 31.

In FIG. 1, among the valves provided in the hydraulic apparatus 9, representative valves relating to the characteristic feature of the present embodiment are illustrated. In actuality, the hydraulic apparatus 9 has various not shown other valves. For example, the hydraulic apparatus 9 has a valve for permitting and prohibiting the supply of hydraulic fluid from the pump 21 to the rod side chamber 13*r*. Further, for example, the hydraulic apparatus 9 may have a passage and valve so that the supply of hydraulic fluid from the pump 21 to the head side chamber 13*h* is possible as well.

The control device 11, for example, although not particularly shown, includes a CPU, ROM, RAM, external memory device, and so on. The control device 11 outputs control signals (control commands) for controlling various portions based on signals which are input, according to a program stored in advance. Note that, the control device 11 may be configured as the control device of the injection apparatus 1 or may be configured as the control device of the die cast machine DC1 which controls not only the operation of the injection apparatus 1, but also the operations of the not shown mold clamping device and not shown ejection device, and so on. Further, the hardware thereof may be dispersed to a plurality of positions (plurality of housings) or may be grouped together.

The devices that inputs signals to the control device 11 include for example an input device 33 receiving an input operation of an operator and a position sensor 37 which detects the position of the plunger 5 (piston rod 17). The devices which the control device outputs signals to for example include the display device 35 for displaying information to the operator, a not shown electric motor for driving the pump 21 (strictly speaking, a driver thereof), and various types of valves (for example a shown valve or a valve which controls the pilot pressure with respect to the shown valve).

Note that, in the above description, as the input sources and output ends of signals, representative ones relating to the explanation of the characteristic feature of the present embodiment are exemplified. In actuality, other than those described above, the injection apparatus 1 has various input sources or output ends. For example, although not particularly shown, the injection apparatus 1 has a not shown pressure sensor for detecting the pressure of the accumulator 23, a not shown pressure sensor for detecting the pressure in the head side chamber 13*h*, a not shown pressure sensor for detecting the pressure in the rod side chamber 13*r*, and so on.

The input device 33 and display device 35 may be given suitable configurations. Parts or all may be integrally configured. For example, the input device 33 and display device 35 may include touch panels and machine switches. The input device 33 for example receives an operation for setting a low injection velocity, high injection velocity, casting pressure, and other molding conditions and an operation for instructing commencement of the molding cycle to the injection apparatus 1.

The position sensor 37 for example detects the position of the piston rod 17 relative to the cylinder part 13 and indirectly detects the position of the plunger 5. The configuration of the position sensor 37 may be a suitable one. For example, the position sensor 37 may be one configuring a magnetic or optical linear encoder together with a not shown scale part which is provided in the piston rod 17 in a fixed manner and extends in the axial direction of the piston rod 17 or may be configured by a laser length measuring device measuring the distance from a member fixed at the piston rod 17.

Note that, the position sensor 37 alone or combination of the position sensor 37 and the control device 11 can acquire the velocity of the plunger 5 as a differential value of the position by repeatedly detecting the position while counting the time. Accordingly, the position sensor 37 may be grasped as a velocity sensor substantially capable of detecting velocity as well.

<Outline of Basic Operation of Injection Apparatus>

Figure 2:
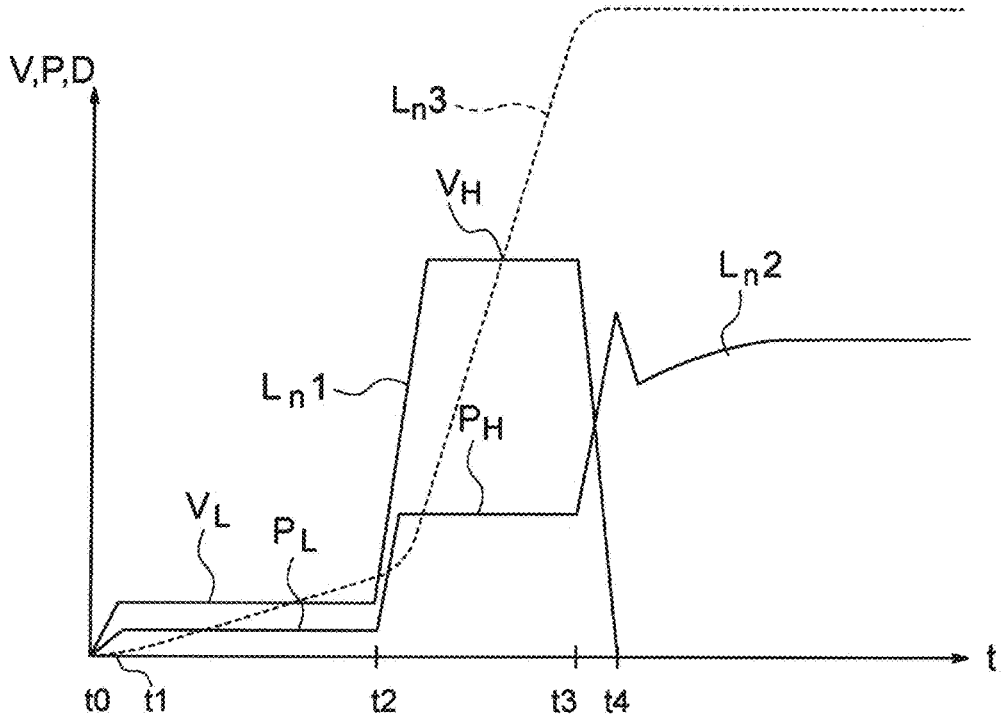
FIG. 2 is a view for explaining an outline of an example of a basic operation of the injection apparatus in FIG. 1.

FIG. 2 is a view for explaining an outline of an example of the basic operation of the injection apparatus.

In the same diagram, an abscissa shows the time "t", and an ordinate shows an injection velocity V, injection pressure P, and position D of the plunger 5. The injection velocity V is the velocity of the plunger 5. The injection pressure P is the pressure which is given by the plunger 5 to the molten metal. Here, the position D is the position of the plunger 5 using the position at the time of start of the injection (time t0) as a reference. From another viewpoint, it is the movement distance D of the plunger 5 from the time of start of the injection and consequently the integral value of the injection velocity V. In the graph, a line Ln1 indicates the change of the injection velocity V along with time, while a line Ln2 indicates the change of the injection pressure P along with time, and a line Ln3 indicates the change of the position D along with time.

The injection apparatus 1, for example, when taking a general view, performs low speed injection (about t0 to t2), high speed injection (about t2 to t3), and pressure increase (boosting, generally t3 or t4~) in that order. The operations in these processes are for example as follows.

(Low Speed Injection)

When the fixed mold 103 and movable mold 105 finish being clamped by the not shown mold clamping device and molten metal is supplied to the sleeve 3, the control device 11 starts the forward movement of the plunger 5 (time t0) and moves the plunger 5 forward at a relatively low injection velocity $V_L$ (times t1 to t2). Due to this, entrapment of air by the molten metal is suppressed while the molten metal in the sleeve 3 is ejected toward the cavity 107. The low injection velocity $V_L$ may be suitably set and for example is less than 1 m/s. In general, it is about 0.2 to 0.3 m/s in many cases and is sometimes set to 0.1 m/s. Further, the low injection velocity $V_L$ is for example a constant value. Note that suitable speed change control may be carried out as well. In the low speed injection, the injection pressure becomes a relatively low pressure (low speed injection pressure $P_L$) since the injection velocity is relatively low.

For the operation as described above, the control device 11, specifically, for example, stops the introduction of the pilot pressure for closing the second valve 27B so as to supply hydraulic fluid from the accumulator 23 through the second passage 25B to the head side chamber 13*h*. Note that, in place of the supply of the hydraulic fluid from the accumulator 23, the hydraulic fluid may be supplied from the pump 21 to the head side chamber 13*h* through a suitable passage and valve. By supply of the hydraulic fluid to the head side chamber 13*h*, the injection piston 15 moves forward and in turn the plunger 5 moves forward. At this time, the hydraulic fluid in the rod side chamber 13*r* reduced in volume along with the forward movement of the injection piston 15 is for example discharged through the third passage 25C to the tank 19. The velocity of the plunger 5 is controlled by the meter-in circuit (flow rate control valve 31) and/or meter-out circuit (flow rate control valve 29).

Note that, the hydraulic fluid discharged from the rod side chamber 13*r* may be refluxed through a not shown passage (run-around circuit) to the head side chamber 13*h*. A meter-out circuit (flow rate control valve 29) may control the flow rate of this reflux as well.

(High Speed Injection)

When the fact that the plunger 5 has reached a predetermined high speed switching position is detected by the position sensor 37 (time t2), the control device 11 makes the plunger 5 move forward at a relatively high injection velocity $V_H$. Due to this, for example, the molten metal is speedily filled in the cavity 107 without a time lag relative to the solidification of the molten metal. The high injection velocity $V_H$ may be suitably set. However, for example, it is 1 m/s or more. The high injection velocity $V_H$ is for example a constant value. Note, suitable speed change control may be carried out as well. In the high speed injection, the injection pressure becomes a high speed injection pressure $P_H$ which is higher than the low speed injection pressure $P_L$ since the injection velocity is relatively high.

For the operation as described above, the control device 11, specifically, for example continues the supply of the hydraulic fluid from the accumulator 23 to the head side chamber 13*h* after the low speed injection while making the degree of opening of the flow rate control valve 31 of the meter-in circuit and/or the flow rate control valve 29 of the meter-out circuit larger. Note that, in the low speed injection, in a case where the hydraulic fluid is supplied to the head side chamber 13*h* not from the accumulator 23, but from the pump 21, the second valve 27B is opened and the source of supply of the hydraulic fluid to the head side chamber 13*h* is switched from the pump 21 to the accumulator 23. The hydraulic fluid in the rod side chamber 13*r*, in the same way as the low speed injection, may be discharged to the tank 19 or may be refluxed to the head side chamber 13*h* through a not shown passage. The velocity of the plunger 5 is controlled by the meter-in circuit (flow rate control valve 31) and/or meter-out circuit (flow rate control valve 29).

(Deceleration, Boosting, and Holding)

When the molten metal is roughly filled in the cavity 107 as the result of high speed injection (time t3), the pressure of the molten metal rises and the plunger 5 decelerates. Note that, deceleration control may be carried out by the meter-in circuit (flow rate control valve 31) and/or meter-out circuit (flow rate control valve 29) at a suitable timing.

After that, the plunger 5 (substantially) stops (time t4) and the pressure of the molten metal rises and reaches the casting pressure (final pressure) (boosting process). Then, the casting pressure is held (holding process). Note that, the casting pressure is the pressure of the molten metal at the time when the force which is applied to the plunger 5 due to a pressure difference between the rod side chamber 13*r* and the head side chamber 13*h* and a reaction force which is received by the plunger 5 from the molten metal are balanced. At this time, the pressure in the rod side chamber 13*r* may be made the tank pressure or may be made a suitable pressure by a prohibition of discharge of the hydraulic fluid from the rod side chamber 13*r* at a suitable timing in the boosting process. Further, the pressure in the head side chamber 13*h*, in the example in FIG. 1 (single barrel type injection cylinder 7), is equal to the pressure in the accumulator 23. In the boosting type injection cylinder, this is equal to the pressure obtained by suitable boosting of the pressure in the accumulator 23 by the booster piston.

Then, when the molten metal solidifies, the mold is opened by the not shown mold clamping device, the die casting is ejected from the mold by a not shown ejection device, the plunger 5 is retracted by the supply of hydraulic fluid to the rod side chamber 13*r*, and so on.

<Servo Configuration for Velocity Control>

As explained above, at least from the start of injection to the end of the high speed injection, velocity control by the flow rate control valve 29 is carried out. This velocity control is basically carried out as feedback control (except the period of a portion as will be explained later). The feedback control is for example directly carried out as position feedback control. Substantially velocity feedback control is carried out. Specifically, this is as follows.

Figure 3A:
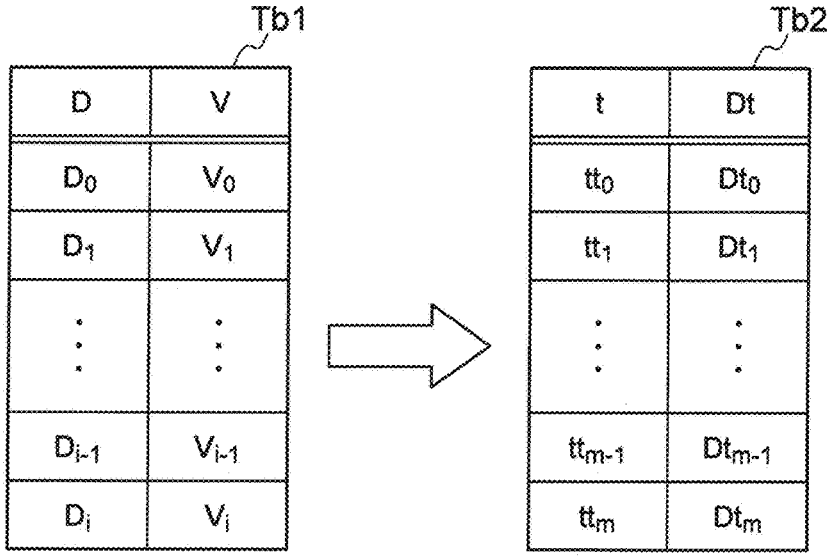
FIG. 3A is a conceptual view showing information relating to a target velocity, generated by the injection apparatus in FIG. 1.

FIG. 3A is a conceptual diagram showing information relating to the target velocity, which is generated by the control device 11.

The control device 11 is set with the target velocity by the operator through the input device 33. The target velocity is for example set for the position D of the plunger 5. Specifically, for example, the control device 11 receives the input of a plurality of positions D of the plunger 5 and the target velocities at the positions D. Due to this, information linking the positions D of the plunger 5 and the target velocities is generated.

A target velocity table Tb1 shown on the left side on the drawing sheet in FIG. 3A shows an example of the information linking the positions D of the plunger 5 and the target velocities which is generated as described above. In the target velocity table Tb1, the plurality of positions $D_0$ to $D_1$ of the plunger 5 and the target velocities $V_0$ to $V_1$ at the positions are linked. The target velocity table Tb1 is for example held in the RAM and/or external memory device.

Note that, the position $D_0$ is for example the position at the time of start of injection. The velocity $V_0$ at this time is 0. The number (i) of the position D for setting the target velocity by the operator is for example suitably set by the operator. Further, the velocity between the position D and the next position D may be specified according to a suitable interpolation by the control device 11. A range of position in which the velocity becomes constant for example may be set between the two positions D by setting of the same target velocity at one position D and at the next position D.

Next, the control device 11 converts the information of the target velocity with respect to the position D (target velocity table Tb1) to information of the target velocity with respect to the elapsed time. A target position table Tb2 shown on the right side on the drawing sheet in FIG. 3A shows an example of such converted information. In the target position table Tb2, the elapsed time (times $tt_0$ to $tt_m$) and the target positions $Dt_0$ to $Dt_m$ at the times are linked. The target position table Tb2 is for example held in the RAM.

The conversion from the target velocity table Tb1 to the target position table Tb2 may be substantially carried out in the same way as the conventional one. For example, first, the control device 11, based on the target velocity table Tb1, performs the interpolation of the target velocity at each of the plurality of positions D having a relatively short pitch width. Then, the control device 11 multiplies the target velocity of the interpolated data by a relatively short predetermined time increment (not more than the time increment of times $tt_0$ to $tt_m$) and integrates the results. Due to this, substantially, the integral value of the target velocity from the start of injection to that elapsed time is calculated for each elapsed time (times $tt_0$ to $tt_m$). That is, the target position for each elapsed time is calculated. In this process of integration, the target velocity to be integrated is changed whenever the integral value (target position) reaches the position D of the interpolation data.

Note that, for the rising edge from the velocity $V_0$ (V=0), for example, the target position may be specified based on the velocity V obtained by interpolation between the velocities $V_0$ and $V_1$ (for example interpolation according to the primary function). Further, the conversion from the target velocity table Tb1 to the target position table Tb2 may be found not according to the approximation described above, but according to an equation.

The time $tt_0$ of the start of control corresponds to the time $t_0$ of the start of injection in FIG. 2. The time $tt_m$ at the end of control corresponds to the end of the velocity control of the injection. For example, it corresponds to the time $t_3$, the time $t_4$ or a suitable time between them in FIG. 2. Note that, in the control during the molding cycle, irrespective of whether the elapsed time reaches the time $tt_m$, the velocity control may be ended and the pressure control for boosting may be started under the condition that a predetermined factor is satisfied (for example, the injection pressure reaches the predetermined pressure). The time increment at the times $tt_0$ to $tt_m$ is for example constant over the injection process. Further, the length of the time increment may be suitably set so that the injection waveform (waveform indicated by the line Ln1 in FIG. 2) is suitably realized. It is for example 1 ms.

Figure 3B:
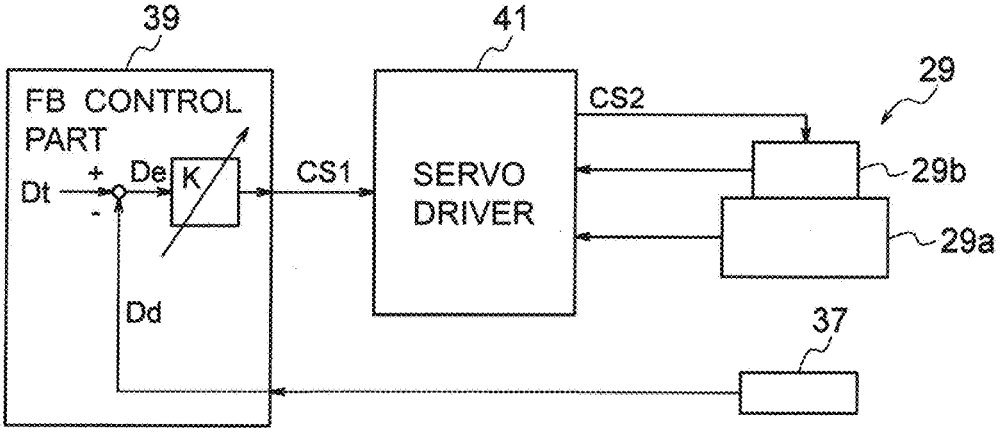
FIG. 3B is a block diagram schematically showing the configuration relating to feedback control of a flow rate control valve in the injection apparatus in FIG. 1.

FIG. 3B is a block diagram showing the configuration relating to the feedback control of the flow rate control valve 29.

This feedback system, in addition to the already explained position sensor 37 and flow rate control valve 29, has an FB control part 39 configured in the control device 11 and a servo driver 41 which converts a control signal CS1 from the FB control part 39 to a suitable control voltage CS2 and outputs the result to the flow rate control valve 29. Note that, the control voltage CS2 is based on the control signal CS1. Therefore, in the following description, sometimes the two will not be differentiated and referred to as the "control commands CS".

The FB control part 39 performs (real time) feedback control of the flow rate control valve 29 so that the target velocity is realized based on the detection value of the position sensor 37. Specifically, for example, for each elapsed time, the FB control part 39 refers to the target position table Tb2 and specifies the target position Dt set with respect to the elapsed time, calculates a deviation De between that specified target position Dt and the position Dd which is detected by the position sensor 37, and outputs a control command Cs having the command value in accordance with the calculated deviation. That is, the FB control part 39 substantially performs velocity feedback control according to position feedback control making the detected position match with the target position which changes along with the elapse of time.

Note that, the cycle (time increment) for performing the feedback control described above is for example the same as the time increment of the elapsed time (times $tt_0$ to $tt_m$) in the target position table Tb2 and is for example about 1 ms.

The conversion from the deviation De to the command value of the control command CS is for example achieved by multiplying a predetermined proportional gain K with respect to the deviation De. That is, in the FB control part 39, proportional control is carried out. Note that, PI control, PD control, PID control, etc. may be carried out, or a fuzzy control or other control system may be suitably introduced.

The servo driver 41 for example not only simply converts the control signal CS1 to the control voltage CS2, but also performs feedback control of the flow rate control valve 29 based on a signal showing the degree of opening which is output from the flow rate control valve 29 so that the degree of opening of the flow rate control valve 29 becomes the degree of opening designated by the control signal CS1. That is, the servo driver 41 performs minor loop feedback control. Note, the servo driver 41 for example may simply convert the control signal CS1 to the control voltage CS2.

Note that, the servo driver 41 may be grasped as a portion of the control device 11 or a portion of the flow rate control valve 29. Further, the servo driver 41 may be arranged together with the control device 11 or may be arranged together with the flow rate control valve 29. In the following description, sometimes an explanation will be given of the control of the flow rate control valve 29 by the control device 11 while omitting the servo driver 41.

In the example shown in FIG. 3B, the flow rate control valve 29 has a main valve 29*a* for opening/closing the third passage 25C and a pilot valve 29*b* for driving the main valve 29*a*. Further, the signal showing the degree of opening of the main valve 29*a* is output to the servo driver 41, and the minor loop feedback control described above is carried out. Further, the signal showing the degree of opening of the pilot valve 29*b* may be output to the servo driver 41, and further minor loop feedback control more than the above minor loop may be carried out.

<Overlap Characteristic of Flow Rate Control Valve>

Figure 4A:
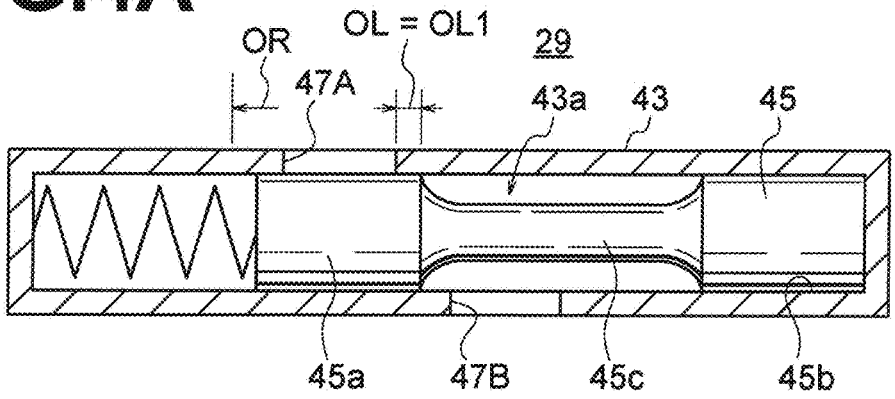
FIG. 4A to FIG. 4C are cross-sectional views for explaining the operation of the flow rate control valve in the injection apparatus in FIG. 1.
Figure 4B:
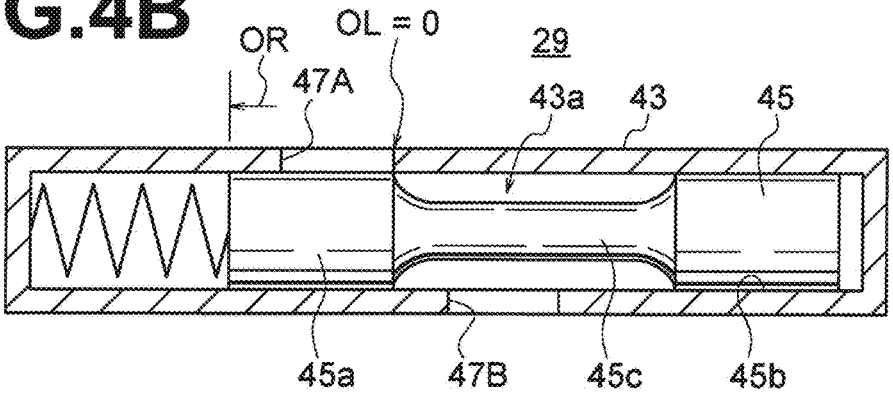
Figure 4C:
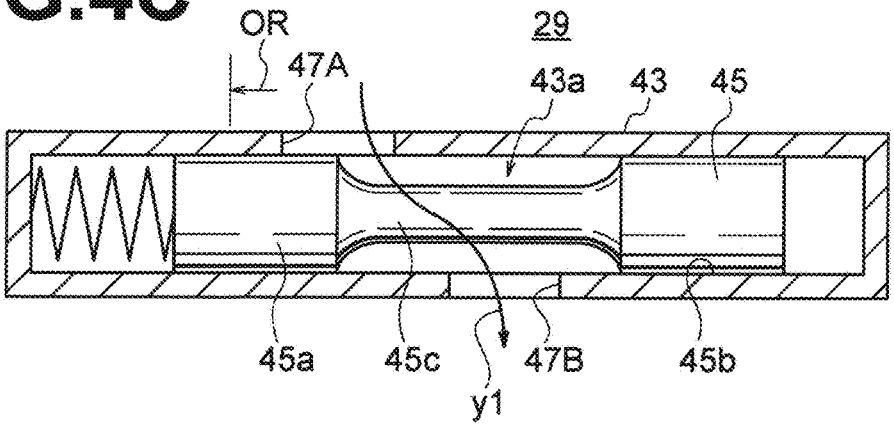

FIG. 4A to FIG. 4C are cross-sectional views schematically showing the configuration of the flow rate control valve 29. Note that, these views are schematic ones for explaining the overlap characteristic and do not show examples of the correct configuration or shape of the flow rate control valve 29.

The flow rate control valve 29 is for example one type of slide valve, that is, a spool type valve, and has a hollow valve main body 43 and a spool 45 capable of sliding in the valve main body 43.

The hollow portion 43*a* of the valve main body 43 extends in the lateral direction on the drawing sheet at a constant cross-section. Further, in the valve main body 43, a first port 47A and second port 47B communicating the hollow portion 43*a* and the external portion of the valve main body 43 are formed. The valve main body 43 is for example assembled in the third passage 25C so that the first port 47A is connected to the rod side chamber 13*r* and the second port 47B is connected to the tank 19. Note that, the connection destinations of the two ports may be reverse to those described above as well.

The spool 45 is a substantially shaft-shaped member and for example has a first land portion 45*a* and second land portion 45*b* having a bit smaller cross-sectional shape than the cross-sectional shape of the hollow portion 43*a* (the shape of the cross-section which is perpendicular to the lateral direction on the drawing sheet) and has a small diameter portion 45*c* which is positioned between these land portions and has a smaller diameter than the land portions. The spool 45 can move inside the hollow portion 43*a* in the lateral direction on the drawing sheet.

FIG. 4A shows a state where the spool 45 is located at a predetermined reference position (neutral point) and the flow rate control valve 29 is closed. At this position, the first land portion 45*a* is positioned at the center in the movement direction of the spool 45 relative to the first port 47A and closes the first port 47A. Due to this, the flow between the first port 47A and the second port 47B is prohibited. At this time, in the movement direction etc. of the spool 45, the first land portion 45*a* overlaps not only the first port 47A, but also the valve main body 43 around the first port 47A. This overlap amount is defined as OL. An overlap amount OL at the time shown in FIG. 4A is defined as OL1.

FIG. 4B shows a state where the spool 45 displaces a little to the opening position from the position in FIG. 4A. Even if the spool 45 displaces from the position in FIG. 4A, the first land portion 45*a* overlaps the periphery of the first port 47A with an overlap amount OL1 in the state in FIG. 4A, therefore the first port 47A is not immediately opened. Specifically, as shown in FIG. 4B, up to the position at which the overlap amount OL becomes 0, the first port 47A is closed by the first land portion 45*a* as it is (is not opened).

FIG. 4C shows a state where the spool 45 further displaces to the opening position side from the position in FIG. 4B. In this state, the state where the first port 47A has been closed by the first land portion 45*a* is released. That is, the first port 47A is opened. Due to this, as indicated by an arrow y1, the flow from the first port 47A to the second port 47B is permitted. Further, the degree of opening of the flow rate control valve 29 is continuously adjusted by displacement of the spool 45 between the position in FIG. 4B and the position in FIG. 4C, and the flow rate is continuously controlled by this.

In this way, in the flow rate control valve 29, at the time when the spool 45 is located in the predetermined overlapping range OR (only the boundary on the left side of the drawing sheet is shown), even if the spool 45 displaces, the first port 47A is not opened. When the spool 45 has passed through the overlapping range OR, the first port 47A is opened. The state of superposition of the valve body (spool 45) and the valve main body where the valve body displaces a little from the reference position and the port is opened first after that is called "overlap". By employing such overlap, for example, at the time when the spool 45 is located at the reference position, the flow of the hydraulic fluid can be more reliably shut off.

A driving force for driving the spool 45 may be directly given from a solenoid (linear electric motor) or may be given by liquid pressure from the pilot valve which is driven by the solenoid (example in FIG. 3B). The flow rate control valve 29 positions the spool 45 at a position in accordance with a command value of the control command CS which is input (for example the position at which the value of the control voltage CS2 and the displacement amount from the reference position become linear).

Figure 5:
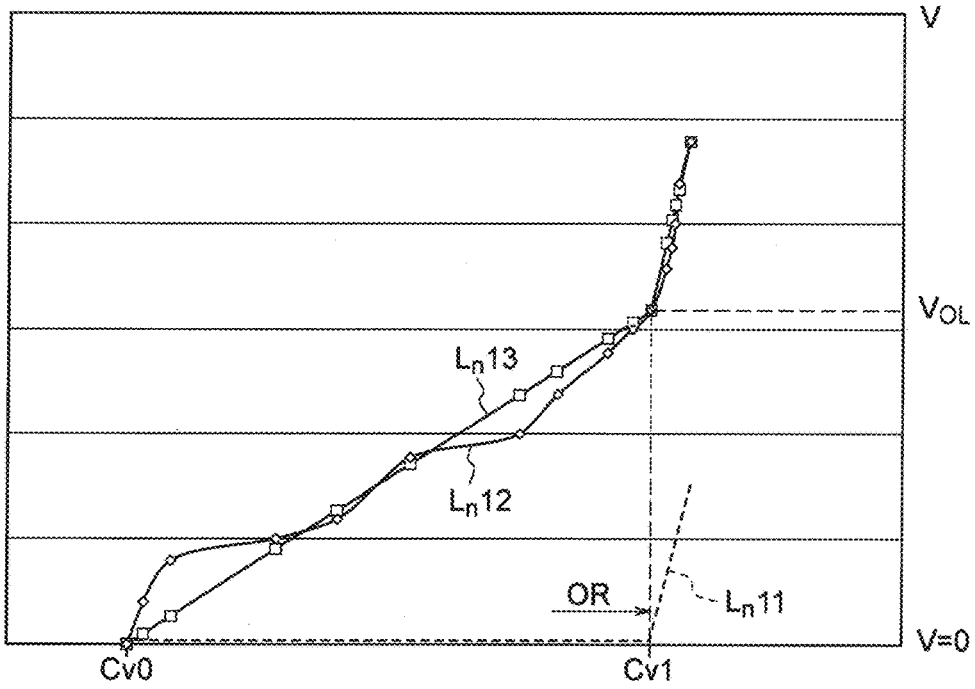
FIG. 5 is a view showing a flow rate characteristic of the flow rate control valve in the injection apparatus in FIG. 1.

FIG. 5 is a graph showing the flow rate characteristic of the overlap type flow rate control valve 29.

In this graph, the abscissa indicates the command value Cv of the control command CS which is input to the flow rate control valve 29. Note that, the flow rate control valve 29 positions the spool 45 at the position in accordance with a command value Cv. Therefore, from another viewpoint, the abscissa shows the position of the spool 45. In FIG. 5, the ordinate indicates the velocity of the plunger 5. Note that, the velocity of the plunger 5 is proportional to the flow rate of the hydraulic fluid which is discharged from the rod side chamber 13*r* through the flow rate control valve 29. Therefore, from another viewpoint, the ordinate shows the flow rate in the flow rate control valve 29.

The lower end of the ordinate corresponds to V=0. To the abscissa, positive/negative and an absolute value are suitably assigned according to the configuration of the flow rate control valve 29. Accordingly, for example, even if the command value Cv and the velocity V have linear relationships, they are not always proportional. Note, in the following description, for convenience of explanation, sometimes the change of the value of the command value Cv will be expressed by assuming that the value of the command value Cv increases more toward the right side on the drawing sheet.

Cv=Cv0 corresponds to the state of OL=OL1 in FIG. 4A. Cv=Cv1 corresponds to the state of OL=0 in FIG. 4B. That is, the range from Cv0 to Cv1 corresponds to the state where the spool 45 is positioned in the overlapping range OR, and the range on the right side of the drawing sheet more than Cv1 corresponds to the state where the spool 45 has passed through the overlapping range OR and the first port 47A is opened.

A line Ln11 indicates the ideal flow rate characteristic of the flow rate control valve 29. A line Ln12 indicates the measured flow rate characteristic of the flow rate control valve 29. A line Ln13 indicates the approximate value with respect to the line Ln12.

As already explained, in the case where the spool 45 is positioned in the overlapping range OR, the first port 47A is closed by the first land portion 45*a*. Accordingly, as indicated by the line Ln11, ideally, the velocity of the plunger 5 is 0. Then, when the command value Cv exceeds Cv1, in accordance with the increase of the value of the command value Cv (for example in the linear relationships), the velocity V rises.

However, between the spool 45 and the inner circumferential surface of the valve main body 43, there is a gap through which the hydraulic fluid (for example oil) can enter. By the provision of such a gap, smooth movement of the spool 45 relative to the valve main body 43 becomes possible. The size of this gap is suitably set according to the structure and size of the flow rate control valve 29. For example, it is a few micrometers to several tens of micrometers. Further, in the flow rate control valve 29, due to so-called gap flow where hydraulic fluid flows through this gap, even if the spool 45 is positioned in the overlapping range OR, the flow from the first port 47A to the second port 47B is generated.

Accordingly, in actuality, as indicated by the line Ln12, even in the state where the spool 45 is positioned in the overlapping range OR, the velocity V changes according to the displacement of the spool 45. Specifically, for example, at the time when the spool 45 is located at the reference position (position corresponding to the command value Cv0), the velocity V is substantially 0. When the displacement from the reference position increases, the velocity V also rises. The relationship between the displacement (command value Cv) and the velocity V at that time is for example, as understood from the line Ln13 of the approximate value as well, substantially linear. Further, the rate of change is smaller than the rate of change from the opening of the first port 47A (Cv>Cv1). The velocity $V_{OL}$ of the plunger 5 at the time when the spool 45 is positioned at the boundary between the overlapping range OR and the section outside of the former (Cv=Cv1) is a velocity lower than the velocity which can be set as the low injection velocity $V_L$ and is for example 0.15 m/s or less or less than 0.1 m/s.

<Problem Caused by Overlap Characteristic>

Figure 6A:
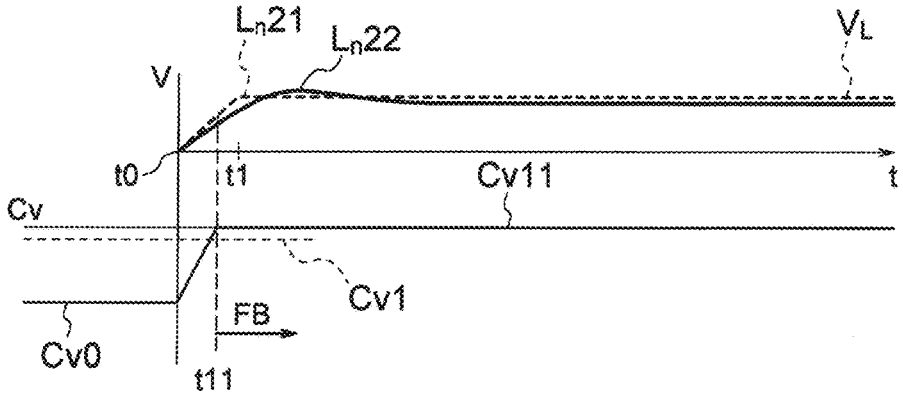
FIG. 6A to FIG. 6C are diagrams for explaining the problem caused by an overlap characteristic and a solution to the same.
Figure 6B:
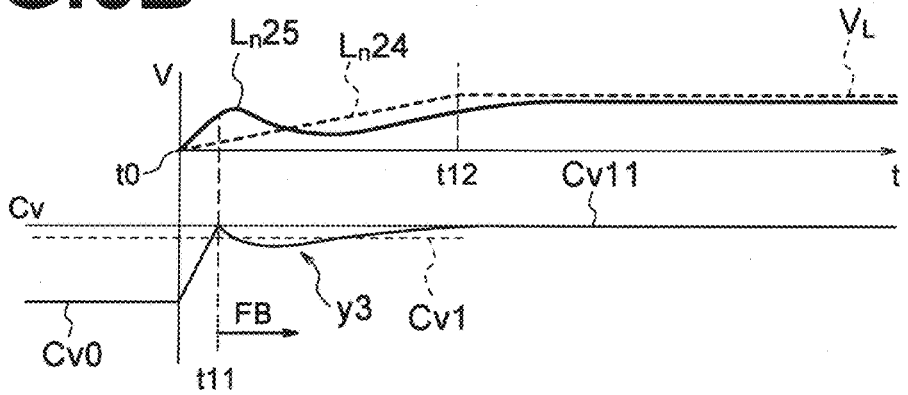

FIG. 6A and FIG. 6B are graphs for explaining the problem caused by the overlap characteristic as described above. In these graphs, the abscissas indicate the times, and the ordinates indicate the injection velocities V and command values Cv. Further, as understood from the notations of the times t0 and t1 and low injection velocity $V_L$, these graphs correspond to the period from the time of start of injection to the middle of the low speed injection.

FIG. 6A is a graph for explaining the control method which is conventionally carried out in the injection apparatus by the applicant. In this graph, a line Ln21 indicates the change along with time of the target value of the injection velocity V which is set by the operator. A line Ln22 indicates the change along with time of the actual injection velocity V.

As explained above, during a period where the spool 45 is positioned in the overlapping range OR, basically the first port 47A is closed by the first land portion 45*a*. Therefore, conventionally, the control device 11 first has made the spool 45 quickly move up to the position passing through the overlapping range OR, has smoothly raised the injection velocity by this, then (after the time t11) has performed the feedback control explained with reference to FIG. 3B.

Specifically, the conventional control device 11 makes the command value Cv of the control command CS change from Cv0 corresponding to the reference position to Cv11 which is larger than Cv1 corresponding to the boundary position of the overlapping range in a relatively short time from the start of injection. The magnitude of Cv11 and the rate of change when changing from Cv0 to Cv11 are basically set by the manufacturer of the injection apparatus 1. That is, the magnitude of Cv11 and the rate of change at the transition from Cv0 to Cv11 are not based on setting of the injection velocity V by the operator, but are constant. Note, the magnitude of Cv11 sometimes can be switched by operation of the input device 33 to either of two stages of magnitude. In the illustrated example, Cv11 is substantially equal to the command value corresponding to the low injection velocity $V_L$.

FIG. 6B is a graph for explaining the problem caused in the control as described above. In this graph, a line Ln24 indicates the change along with time of the target value of the injection velocity V set by the operator. A line Ln25 indicates the change along with time of the actual injection velocity V.

As shown in this diagram, in recent years, at the time of start of injection, sometimes the injection velocity is set so that the injection velocity is not made to speedily reach a low injection velocity $V_L$, but is made reach a low injection velocity $V_L$ with a relatively moderate velocity gradient (made to reach it at the time t12). In such case, when the command value Cv is changed to Cv11 by the time t11 in the same way as FIG. 6A, the actual velocity becomes much larger than the target velocity near the time t11. Next, the velocity slowly falls, then the actual velocity converges to the target velocity. That is, the trackability of the actual velocity with respect to the target velocity is low.

As the reasons for that, for example, the following reasons may be mentioned. The command value Cv at the time t11 is larger relative to the target velocity at the time t11. Even if the command value Cv is within a range not more than Cv1 (even if the spool 45 is positioned in the overlapping range), the flow rate of the hydraulic fluid is not 0, therefore the actual velocity sometimes exceeds the target velocity due to this. Further, the proportional gain K of feedback control (FIG. 3B) is set using the time when the command value Cv exceeds Cv1 (time when the spool 45 has passed through the overlapping range) as a reference. Accordingly, when the command value Cv becomes lower than Cv1 as in the region indicated by an arrow y3 (when the spool 45 is located in the overlapping range), the proportional gain K is smaller compared with the amount of change of the flow rate with respect to the command value Cv, therefore the injection velocity cannot be made to smoothly track the target value.

<Control Considering Overlap Characteristic>

(Switching of Control System)

Figure 6C:
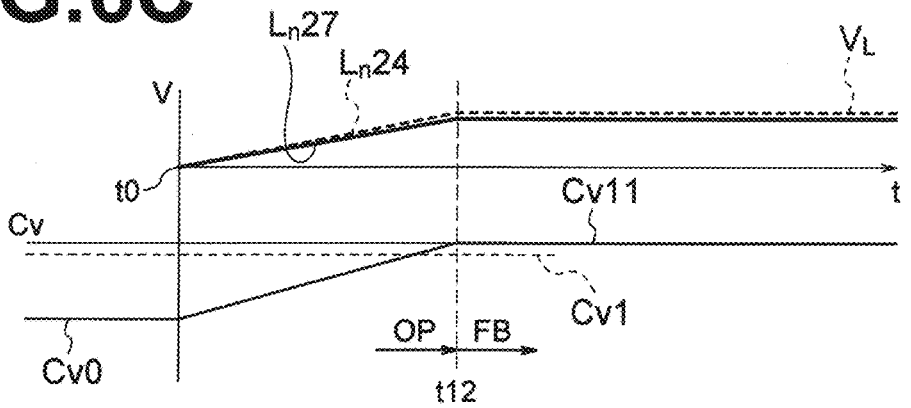

FIG. 6C is a graph corresponding to FIG. 6A and FIG. 6B for explaining the outline of the control which is carried out by the injection apparatus 1 according to the present embodiment in order to solve the problem as described above. The line Ln24, in the same way as the line Ln24 in FIG. 6B, indicates the change along with time of the target value of the injection velocity V set by the operator. A line Ln27 indicates the change along with time of the actual injection velocity V.

As described above, conventionally, irrespective of the target value of the injection velocity V which was set by the operator through the input device 33, in the flow rate control valve 29, at the time of start of the injection, control where the spool 45 passes through the overlapping range OR and gives a constant degree of opening was carried out for a relatively short time determined in advance.

On the other hand, in the present embodiment, at the time of start of injection, the control device 11 performs open control in accordance with the target value of the injection velocity V set by the operator through the input device 33, then performs feedback control. In this open control, the flow rate characteristic of the flow rate control valve 29 at the time when the spool 45 is located in the overlapping range is also considered. In other words, in this open control, the change along with time of the command value corresponding to the movement of the spool 45 in the overlapping range changes in accordance with the target velocity set by the operator. Due to this, for example, even in a case where the set target velocity reaches the low injection velocity $V_L$ with a relatively moderate velocity gradient, the actual velocity suitably tracks the target velocity.

For example, in a case where the target velocity set by the operator reaches the low injection velocity $V_L$ at the time t12 and then the low injection velocity $V_L$ is maintained in a certain degree of period (for example the period up to the commencement of the high speed injection), the control device 11 performs open control until the time t12, then performs feedback control. The command values Cv from the time t0 to the time t12 are set by specifying the command values Cv in accordance with the target velocities with reference to the information of the correspondences between the command values Cv and the velocities V as shown in FIG. 5.

Figure 7:
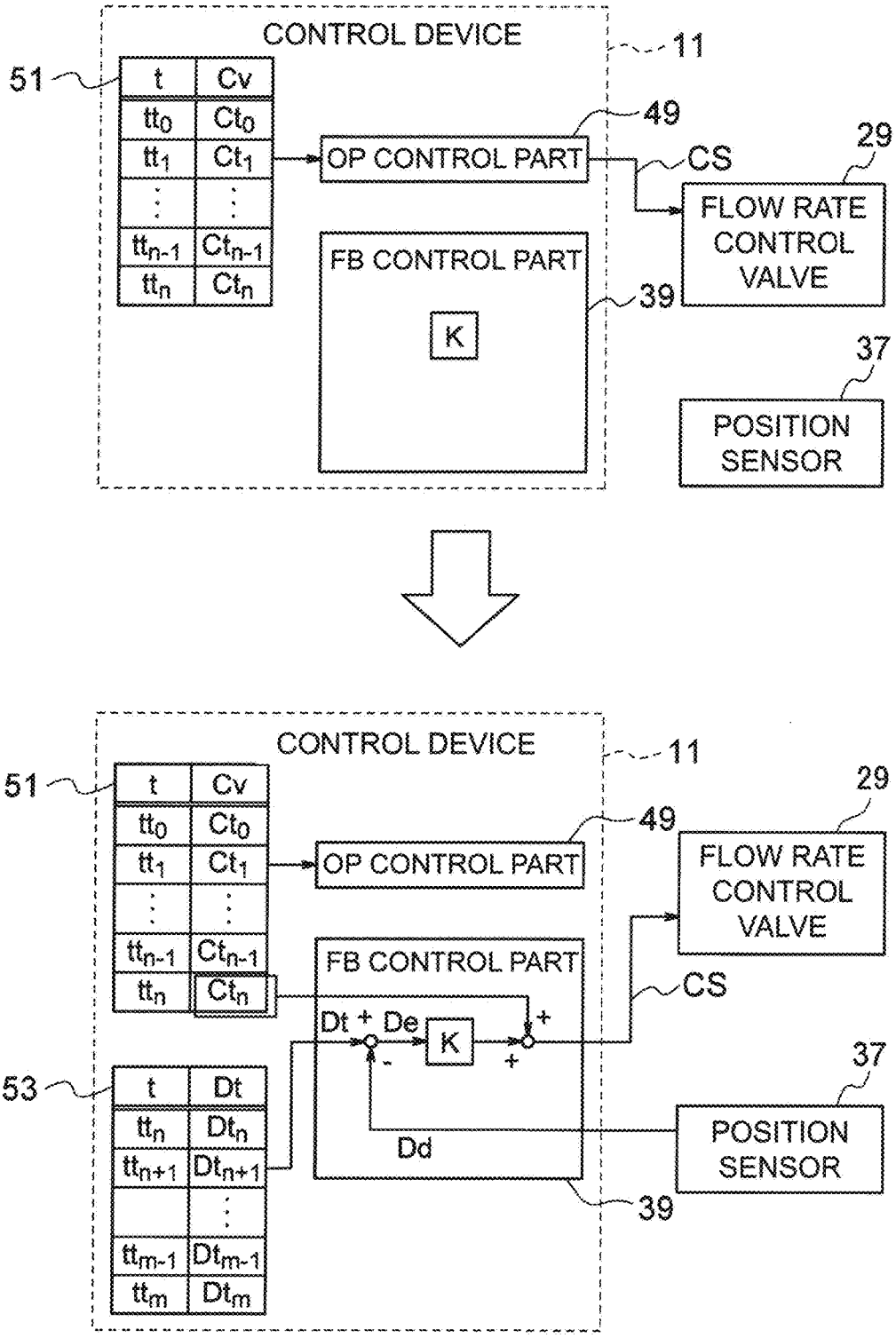
FIG. 7 is a schematic view for explaining an operation of switching a control system in the injection apparatus in FIG. 1.

FIG. 7 is a schematic view showing the change of the operation of the control device 11 at the time of transition from open control to feedback control. The diagram on the upper side of the drawing sheet corresponds to the state where open control is carried out at the time of start of injection, and the diagram on the lower side of the drawing sheet corresponds to the state where feedback control is carried out after the open control.

As shown on the upper side of the drawing sheet in FIG. 7, the control device 11 has an OP control part 49 for performing the open control of the flow rate control valve 29 in addition to the FB control part 39 explained with reference to FIG. 3B. Further, the control device 11 generates an OP control-use table 51 as the information for defining the command value Cv for each elapsed time and holds this in the RAM or the like.

The OP control-use table 51 for example holds the times $tt_0$ to $tt_n$ of the predetermined time increment and the command values $Ct_0$ to $Ct_n$ corresponding to the target velocities at the times linked together. The OP control-use table 51, as explained above, is generated by specifying the command value Cv corresponding to the target velocity for each elapsed time with reference to the information of the flow rate characteristic of the flow rate control valve 29 as in FIG. 5.

Then, the OP control part 49 outputs the control command CS of the command value Cv set for each elapsed time to the flow rate control valve 29 in order with reference to the OP control-use table 51. Note that, in this open control as well, naturally minor loop feedback control by the servo driver 41 may be carried out.

Note that, the time $tt_0$ of the start of control corresponds to the time t0 of the start of injection in FIG. 6C in the same way as FIG. 3A. The command value $Ct_0$ corresponds to the command value Cv0 (velocity 0) in FIG. 6C. Note that, the data at the time $tt_0$ (t0) (data corresponding to the velocity 0) is actually unnecessary for the OP control-use table 51.

The time $tt_n$ of the end of control corresponds to the time t12 at which the injection velocity becomes constant in FIG. 6C (low injection velocity $V_L$). The command value $Ct_n$ corresponds to the command value Cv11 (low injection velocity $V_L$) in FIG. 6C. Note that, the time $tt_n$ may be the time which becomes immediately before or immediately after the time t12 by about one time increment's worth during the times $tt_0$ to $tt_n$. This case is also included in the case where open control is carried out until the time t12.

The time increment (time increment of times $tt_0$ to $tt_n$ in the OP control-use table 51) for changing the command value Cv by the OP control part 49 is for example constant over the open control. Further, the time increment may be the same as the time increment in the feedback control or may be different from the latter. The length of the time increment may be suitably set. For example, it is about 1 ms.

In the generation of the OP control-use table 51 and the control according to the OP control part 49, it is not particularly necessary to perform judgment for distinguishing the inside/outside of the overlapping range OR and so on. The time increment of the times $tt_0$ to $tt_n$ is relatively short and the velocity near the time of start of injection (for example low injection velocity $V_L$) is relatively low. Further, the information including the flow rate characteristic of the overlapping range OR as shown in FIG. 5 is referred to. As a result, the command value Cv causes a change along with time in accordance with the target velocity set by the operator even within the range at the time when the spool 45 is located in the overlapping range OR (within the range of command values Cv0 to Cv1 in FIG. 5).

When the OP control part 49 ends the control up to the time $tt_n$, as shown on the lower side of the drawing sheet in FIG. 7, the FB control part 39 outputs the control command CS to the flow rate control valve 29 in place of the OP control part 49. The outline of the operation is as explained with reference to FIG. 3B.

The control device 11, as explained with reference to FIG. 3A, can generate the target position table Tb2 and holds information from the time $tt_n$ (or $tt_{n+1}$ according to a concrete control system) of the end of the open control in the RAM or the like as the information for feedback control. That is, the control device 11 holds the FB control-use table 53 linking the times $tt_n$ to $tt_m$ of the predetermined time increment and the target positions $Dt_n$ to $Dt_m$ at the times. Then, the FB control part 39, as explained with reference to FIG. 3, specifies the target position Dt at that time for each elapsed time and multiplies the deviation De by the proportional gain to set the command value Cv.

The FB control part 39 takes in as an offset the command value Cv of the control command CS (command value $Ct_n$ in the OP control-use table 51) which is output from the OP control part 49 when changing from feedback control to the open control. That is, it adds the command value $Ct_n$ to the command value obtained by multiplying the deviation De by the proportional gain K and thereby obtains a final command value Cv. Due to this, for example, it becomes easy to eliminate the constant deviation.

(Generation of Characteristic Data of Flow Rate Control Valve)

As explained above, in the generation of the OP control-use table 51, the information of the flow rate characteristic of the flow rate control valve 29 as shown in FIG. 5 is referred to. This flow rate characteristic varies not only among different kinds of products, but also among the same kind of products (same design values). As the factor of this, there can be mentioned dimensional error when fabricating the flow rate control valves 29, the difference of size of the die cast machine DC1 provided with the flow rate control valve 29, and so on. Further, even in one flow rate control valve 29, the flow rate characteristic changes along with time due to wear or the like. Therefore, the injection apparatus 1 measures the flow rate characteristic at a suitable timing and updates the information of the flow rate characteristic (generates it in an initial stage).

Figure 8:
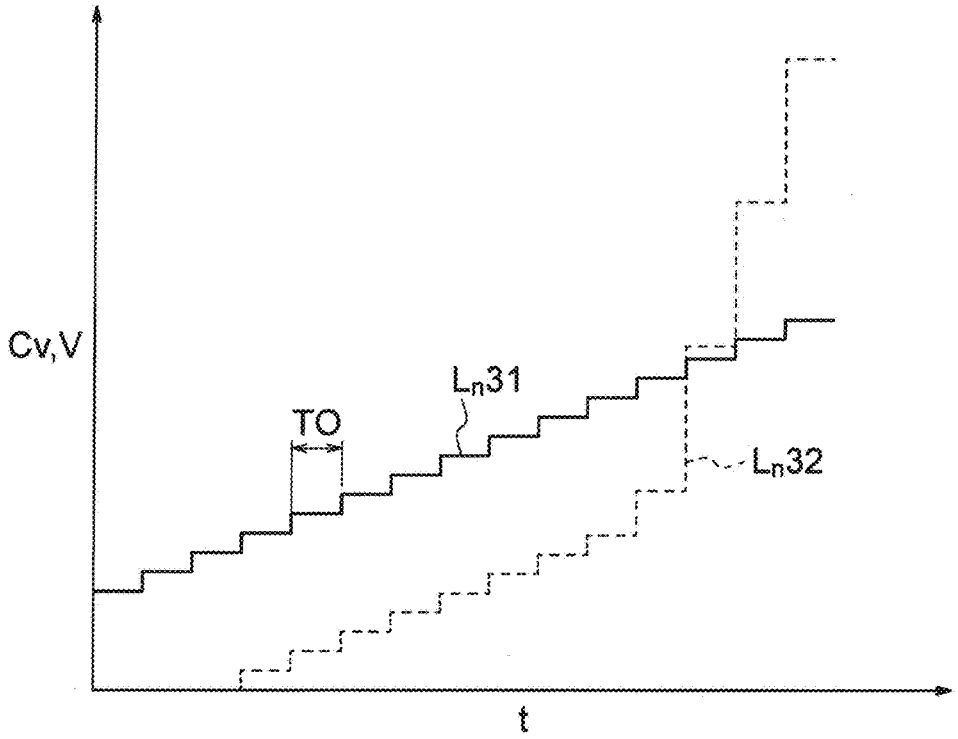
FIG. 8 is a schematic view for explaining an example of the operation when the injection apparatus in FIG. 1 measures the flow rate characteristic.

FIG. 8 is a schematic view for explaining an example of the operation at the time when the injection apparatus 1 measures the flow rate characteristic.

In this graph, the abscissa indicates the time "t", and the ordinate indicates the command value Cv and the velocity V of the plunger 5. A line Ln31 indicates the change along with time of the command value Cv, and a line Ln32 indicates the change along with time of the velocity V of the plunger 5.

The velocity V of the plunger 5 indicated by the line Ln32 is the measured value at the time when the control command CS of the command value Cv indicated by the line Ln31 is output to the flow rate control valve 29. The measurement of the velocity V is for example carried out by the position sensor 37. The operation shown in this diagram is separately carried out from the molding cycle. Further, this operation is for example carried out in so-called air-shot state where the molten metal is not supplied to the sleeve 3.

The control device 11, for example, as indicated by the line Ln31, outputs the control commands CS in order for the plurality of command values Cv. Further, the control device 11, for example, outputs the control command CS over the predetermined time T0 for each command value Cv. Then, the control device 11 detects the velocity V of the plunger 5 at the time when the control command CS of each command value Cv is output. Due to this, the control device 11 can specify the velocity V of the plunger 5 corresponding to the command value Cv and consequently the information of the flow rate characteristic as shown in FIG. 5 is generated.

Note that, the order of output of the control commands CS for various command values Cv may be one where the command value Cv gradually becomes larger (the flow rate gradually becomes larger) as in the illustrated example. Conversely, it may be one where it gradually become smaller or becomes random. The duration of the time T0 and the amount of variation when changing the command value Cv may be for example constant with respect to various command values Cv and concrete values thereof may be suitably set. The range of the command value Cv to be measured is made enough to generate the OP control-use table 51 and includes at least the range of the command value Cv corresponding to the duration from the reference position of the spool 45 (FIG. 4A) to when it passes through the overlapping range OR. Note that, these measurement-use parameters are basically set by the manufacturer of the injection apparatus 1, but may be set through the input device 33 by the operator as well. As the velocity V at each time T0, for example, use may be made of a mean value of the velocities V which are measured during that time T0.

The above operation may be automatically carried out by the control device 11 at the time when a predetermined condition is satisfied (for example when the predetermined timing comes) or may be carried out at the time when a predetermined operation is carried out by the operator. Further, the timing for performing the above operation may be suitably selected. It is for example the time of start of the first operation after the die cast machine is shipped, the time of start of routine operation, the time when the judgment of the result of control is negative in the quality judgment (which will be explained later), and any timing set by the operator.

(Judgment of Quality of Result of Control)

Figure 9:
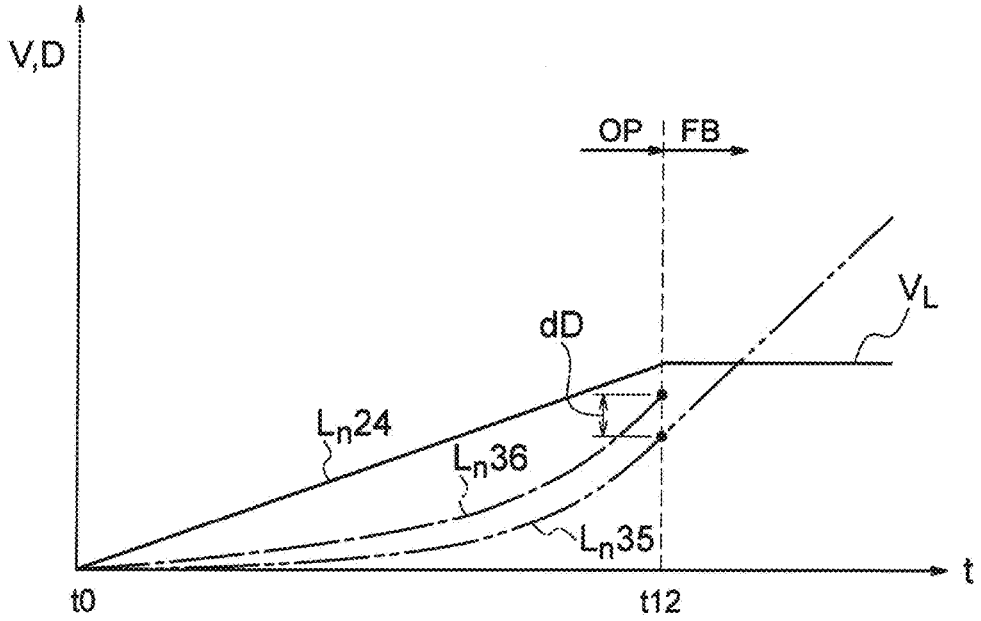
FIG. 9 is a view for explaining a method of judging a quality of the control result by open control.

FIG. 9 is a graph for explaining a method of judgment of quality of the result of control by the open control.

In this graph, the abscissa indicates the time "t". The ordinate indicates the velocity V of the plunger 5 and the position D of the plunger 5. As understood from the notations of the times t0 and t12 and low injection velocity $V_L$, this diagram shows the change along with time at the time of start of injection in the case when the setting the injection velocity shown in FIG. 6C.

The line Ln24 indicates the change along with time of the target velocity V in the same way as FIG. 6C. The line Ln35 indicates the change along with time of the target position D found from the target velocity V. The line Ln36 indicates the change along with time of an actual position D of the plunger 5 (detection value by the position sensor 37).

Ideally, the line Ln36 indicating the detection position by the position sensor 37 coincides with the line Ln35 indicating the target position. However, for example, if the flow rate characteristic changes due to the change along with time of the flow rate control valve 29, the line Ln36 no longer coincides with the line Ln35 as in the illustrated example.

Therefore, the control device 11, for example, calculates the difference dD between the target position and the detection position at the time when the open control ends (the time may be before or after the end by the amount of about one time increment of the open control) and makes the display device 35 display a predetermined warning image when this difference dD exceeds a predetermined threshold value. Due to this, for example, the operator can learn the timing at which the information of the flow rate characteristic must be updated. The warning image for example displays predetermined words and/or predetermined graphics to notify that the difference dD exceeds a threshold value or prompt update of the information of the flow rate characteristic.

(Block Diagram and Flow Chart)

Figure 10:
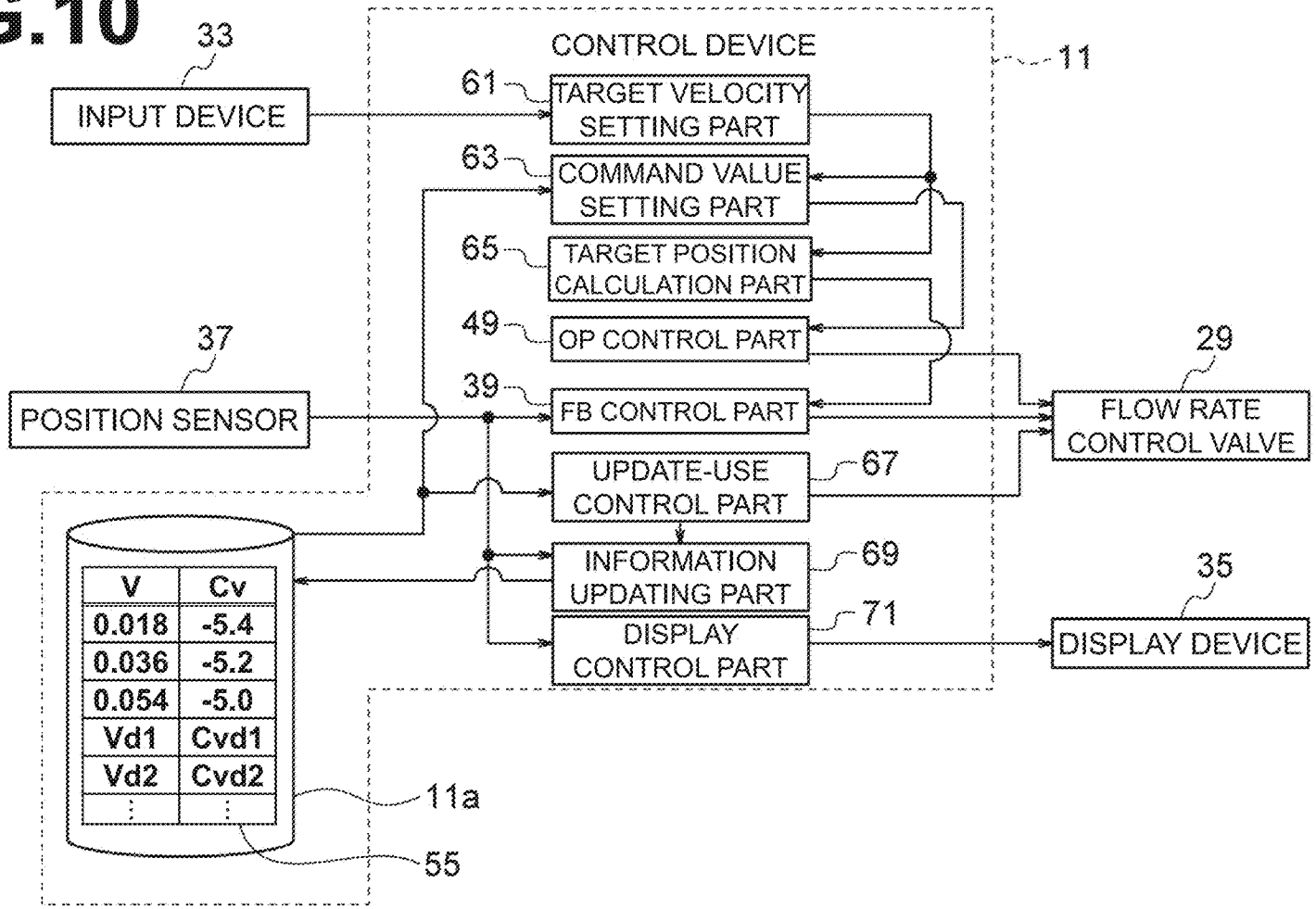
FIG. 10 is a block diagram showing the configuration of a signal processing system in the injection apparatus in FIG. 1.

FIG. 10 is a block diagram conceptually showing the configuration of a signal processing system for realizing control considering the overlap characteristic as described above.

The control device 11 generates the characteristic table 55 as information capable of specifying the flow rate characteristic as shown in FIG. 5 and holds this in the memory unit 11*a*. The characteristic table 55 for example holds a plurality of command values Cv and the velocities of the plunger 5 measured when the control commands CS of the command values Cv are output linked together. The memory unit 11*a* is for example an external memory device.

In the control device 11, the CPU runs program stored in the ROM and/or external memory device to realize various types of functional parts (39, 49, 61, 63, 65, 67, 69, and 71). The operations of the functional parts are for example as follows.

The target velocity setting part 61 sets the target velocity based on a signal from the input device 33 in response to an operation of the operator. For example, the target velocity setting part 61 generates the target velocity table Tb1 shown in FIG. 3A.

The command value setting part 63 sets the command value for each elapsed time for the open control based on the target velocity table Tb1 generated by the target velocity setting part 61 and on the characteristic table 55 held in the memory unit 11*a*. For example, the command value setting part 63 generates the OP control-use table 51 shown in FIG. 7.

The target position calculation part 65 calculates the target position for each elapsed time for the feedback control based on the target velocity table Tb1 generated by the target velocity setting part 61. For example, the target position calculation part 65 generates the FB control-use table 53 shown in FIG. 7.

Note that, as understood also from the explanation of the flow chart which will be explained later, the command value setting part 63 utilizes the target position table Tb2 shown in FIG. 3A. The target position calculation part 65 can be used also for the generation of this target position table Tb2.

The OP control part 49 is as explained with reference to FIG. 7. Further, the FB control part 39 is as explained with reference to FIG. 3B and FIG. 7.

The update-use control part 67 performs the operation explained with reference to FIG. 8. That is, it outputs the control command CS to the flow rate control valve 29 so that the change along with time of the command value Cv indicated by the line Ln31 in FIG. 8 is realized. Note that, as the command value Cv of the control command CS to be output, the command value Cv held in the characteristic table 55 may be used.

The information updating part 69 acquires the velocity of the plunger 5 detected by the position sensor 37 at the time when the update-use control part 67 outputs the control command CS of the command value Cv indicated by the line Ln31 in FIG. 8. That is, the information updating part 69 acquires the velocity V indicated by the line Ln32 in FIG. 8. Then, the information updating part 69, based on the acquired value of the velocity V, updates the value of the velocity V linked with each command value Cv in the characteristic table 55.

The display control part 71 performs the quality judgment explained with reference to FIG. 9 based on the target position set by the target velocity setting part 61 and the position detected by the position sensor 37. That is, the display control part 71 judges whether the difference dD between the target position and the detected position at the time of end of the open control exceeds a predetermined threshold value. Then, the display control part 71, when judging that the difference dD exceeds the threshold value, outputs the control command to the display device 35 so as to display a predetermined alarm.

Figure 11:
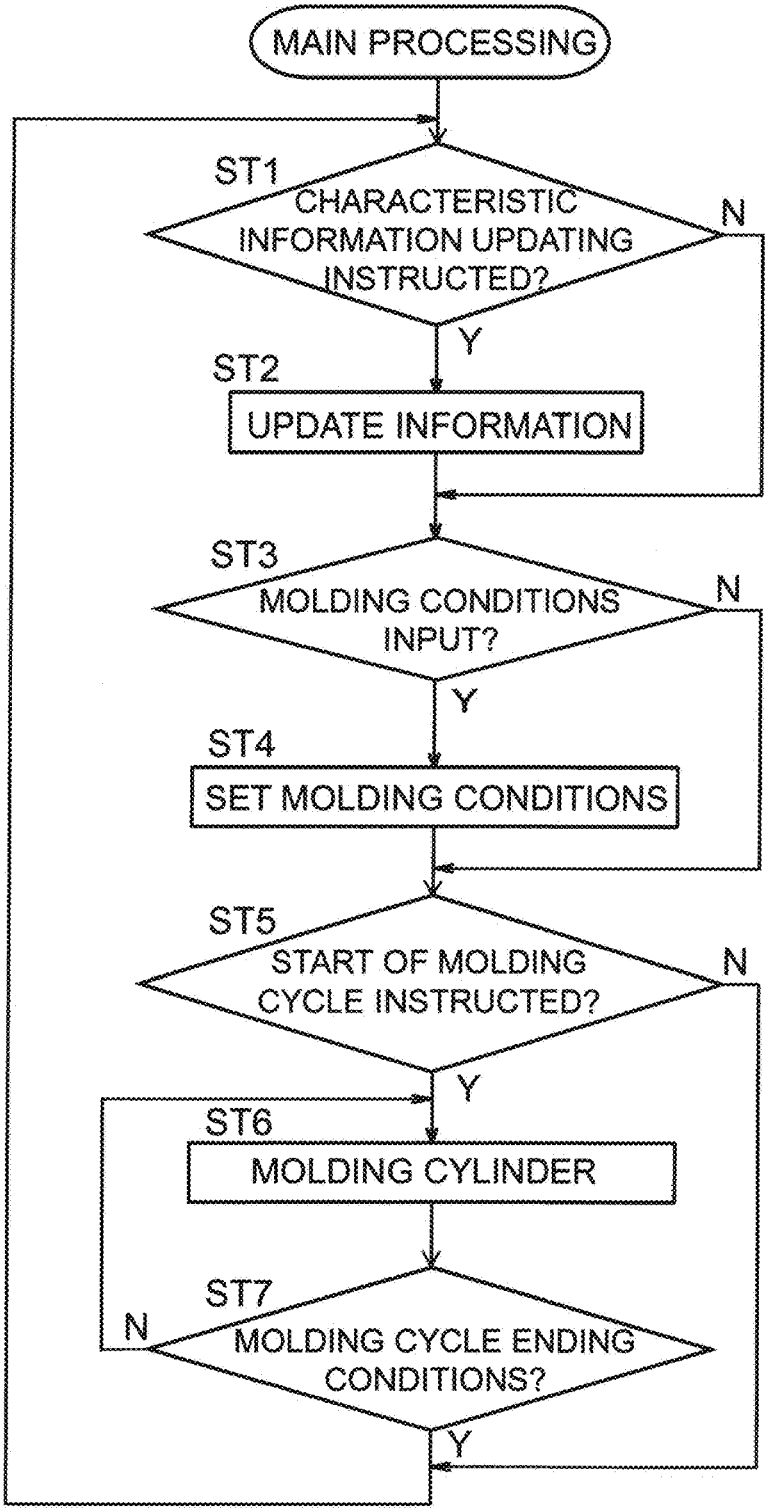
FIG. 11 is a flow chart showing an example of the routine of main processing which is performed by a control device in the injection apparatus in FIG. 1.

FIG. 11 is a flow chart showing an example of the routine of the main processing which is executed by the control device 11 in order to realize the control considering the overlap characteristic. This processing is started for example at the time when the power of the control device 11 is turned on.

At step ST1, the control device 11 judges whether an operation instructing updating of the characteristic table 55 is carried out with respect to the input device 33. Further, the control device 11 proceeds to step ST2 when yes, while skips step ST2 when no.

At step ST2, the control device 11 updates the characteristic table 55 as explained with reference to FIG. 8. That is, the control device 11 outputs the control commands CS of various command values Cv to the flow rate control valve 29 in order, measures the velocities V at those times, and updates the value of the velocity V in the characteristic table 55 based on the measurement results.

In this way, in the illustrated example, the characteristic table 55 is updated in response to operation of the input device 33 by the operator. Note, as already alluded to, in addition to or place of the operation of the operator, the control device 11 may automatically update the characteristic table 55 when a predetermined condition is satisfied. The predetermined condition is for example that the present time is immediately after tuning on of the power of the die cast machine DC1 or that the judgment at step ST24 which will be explained later is that the result of control is not good.

At step ST3, the control device 11 judges whether the operation for setting the molding conditions was carried out with respect to the input device 33. Further, the control device 11 proceeds to step ST4 when yes, while skips step ST4 when no. Note that, the molding conditions are for example the injection velocity and casting pressure.

At step ST4, the control device 11 sets the molding conditions based on the information input by operation by the input device 33.

At step ST5, the control device 11 judges whether an operation for starting the molding cycle was carried out with respect to the input device 33. Further, the control device 11 proceeds to step ST6 when yes, and while skips steps ST6 and ST7 when no.

At step ST6, the control device 11 outputs a control command so that the molding cycle is carried out one time under the molding conditions set at step ST4. Due to this, for example, the clamping by the mold clamping device, injection by the injection apparatus 1, opening of the mold by the mold clamping device, ejection of the molded article by the ejection device, and so on are carried out.

At step ST7, the control device 11 judges whether a condition for ending the repetition of the molding cycle is satisfied. For example, it is judged whether step ST6 is repeated by the number of cycles set at step ST4. Further, the control device 11, proceeds to the next step when yes (returns to step ST1 in the illustrated example), while returns to step ST6 when no and repeats the molding cycle.

Figure 12:
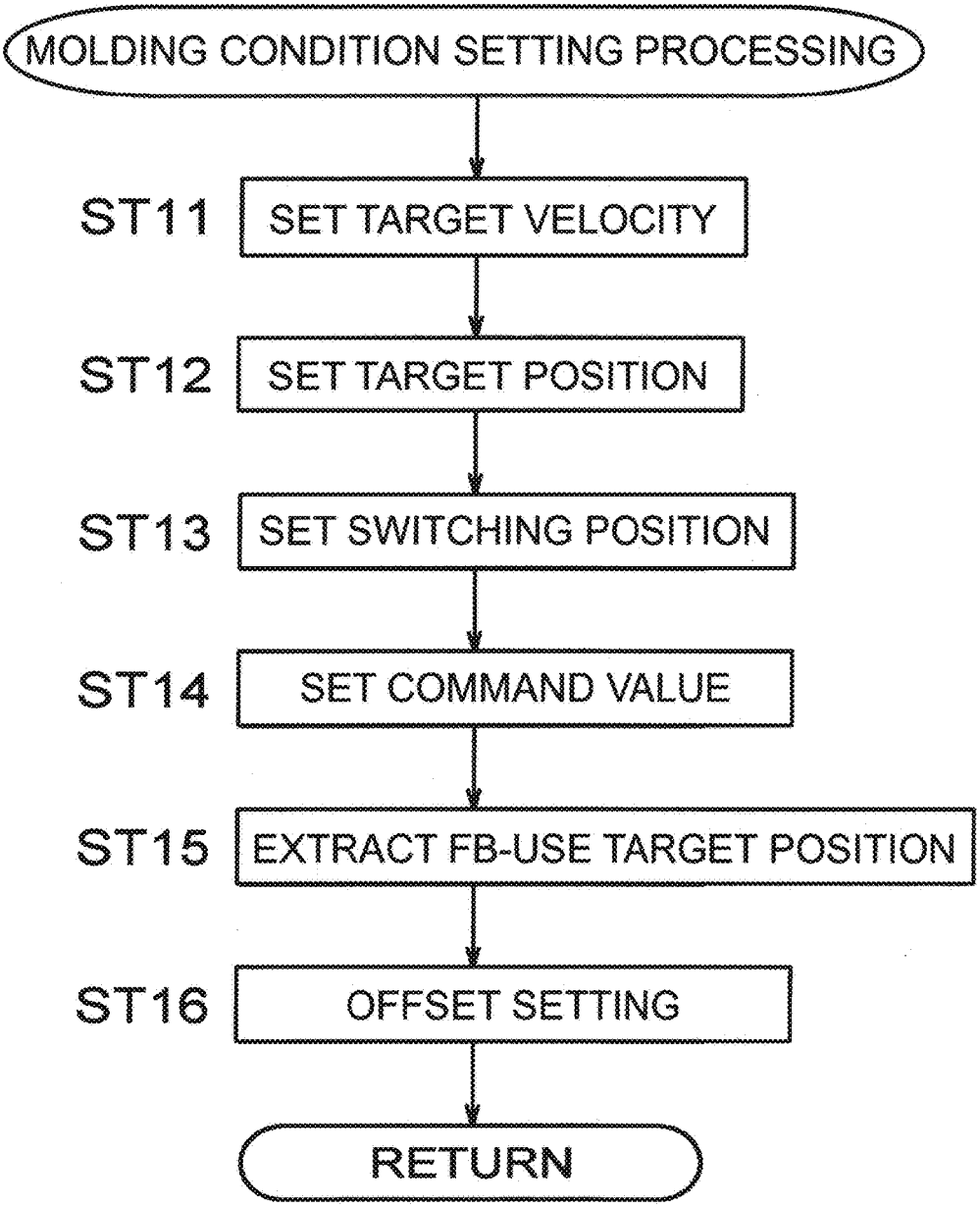
FIG. 12 is a flow chart showing an example of processing for setting molding conditions which is performed at step ST4 in FIG. 11.

FIG. 12 is a flow chart showing an example of the molding condition setting processing executed at step ST4 in FIG. 11 by the control device 11. Note, in this chart, only the routine for setting the injection velocity in the routine for setting the molding conditions is shown.

At step ST11, the control device 11 generates the target velocity table Tb1 shown in FIG. 3A based on the signal from the input device 33.

At step ST12, the control device 11, as explained with reference to FIG. 3A, generates the target position table Tb2 based on the target velocity table Tb1.

At step ST13, the control device 11 sets the position of the plunger 5 for switching from open control to feedback control. For example, the control device 11 specifies the position at which the constant velocity (usually the low injection velocity $V_L$) will be realized first at the time of start of injection based on the target velocity table Tb1 and determines this position as the position at which the switching is carried out. Note that, the operator may be able to designate the switching position among the plurality of positions D held in the target velocity table Tb1 or separately from the positions D in the target velocity table Tb1 through the input device 33 as well.

At step ST14, the control device 11 generates the OP control-use table 51 shown in FIG. 7. Specifically, for example, first, the control device 11 compares the target position Dt in the target position table Tb2 generated at step ST12 with the switching position set at step ST13 and extracts data corresponding to the range from the injection start position to the switching position (range where the open control is carried out) from the target position table Tb2. Further, the control device 11 specifies the target velocities corresponding to the plurality of target positions Dt of the extracted data based on the target velocity table Tb1. Due to this, the elapsed time of the data extracted from the target position table Tb2 and the target velocity defined in the target velocity table Tb1 are linked and in turn a table of the target velocity with respect to the elapsed time can be generated.

The specifying method when specifying the target velocities corresponding to the plurality of target positions Dt of the data extracted from the target position table Tb2 based on the target velocity table Tb1 may be a suitable method. For example, as explained in the method of converting the target velocity table Tb1 to the target position table Tb2, the interpolated data of the target velocity table Tb1 is generated, and the target velocity of the interpolated data is multiplied by the predetermined time increment and integrated in that order. Then, at the time when that integral value (target position) reaches (exceeds) the target position Dt of the table extracted from the target position table Tb2 described above, the target velocity at that time may be defined as the target velocity corresponding to the target position Dt. Naturally, it may be found from an equation as well.

After that, the control device 11 specifies the command value corresponding to the target velocity in the table linking the elapsed time and the target velocity as described above based on the characteristic table 55. For example, when the target velocity Vt is a value between the velocities Vd1 and Vd2 which are held in the characteristic table 55 and the command values linked with the velocities Vd1 and Vd2 are Cvd1 and Cvd2, the command value Cv which corresponds to the target velocity Vt may be found according to $Cv=Cd1+(Cd2-Cd1)\times(Vt-Vd1)/(Vd2-Vd1)$ (may be found from two data before and after the target velocity Vt). Naturally, an approximation equation approximating the plurality of data in the characteristic table 55 may be found, and the target velocity may be entered into this approximation equation to calculate the command value as well. Note, in this case, preferably the approximation equation is made different between the overlapping range OR and the outside thereof. The command value of the boundary for separating the approximation equation is for example set by the manufacturer in advance.

At step ST15, the control device 11 extracts the FB control-use table 53 shown in FIG. 7 from the target position table Tb2 generated at step ST12 based on the switching position set at step ST13. This extracted FB control-use table 53 is basically the remainder after extraction at step ST14.

At step ST16, the control device 11, as explained with reference to FIG. 7, sets the last command value of the open control among the command values for open control set at step ST14 as the offset of the feedback control.

Figure 13:
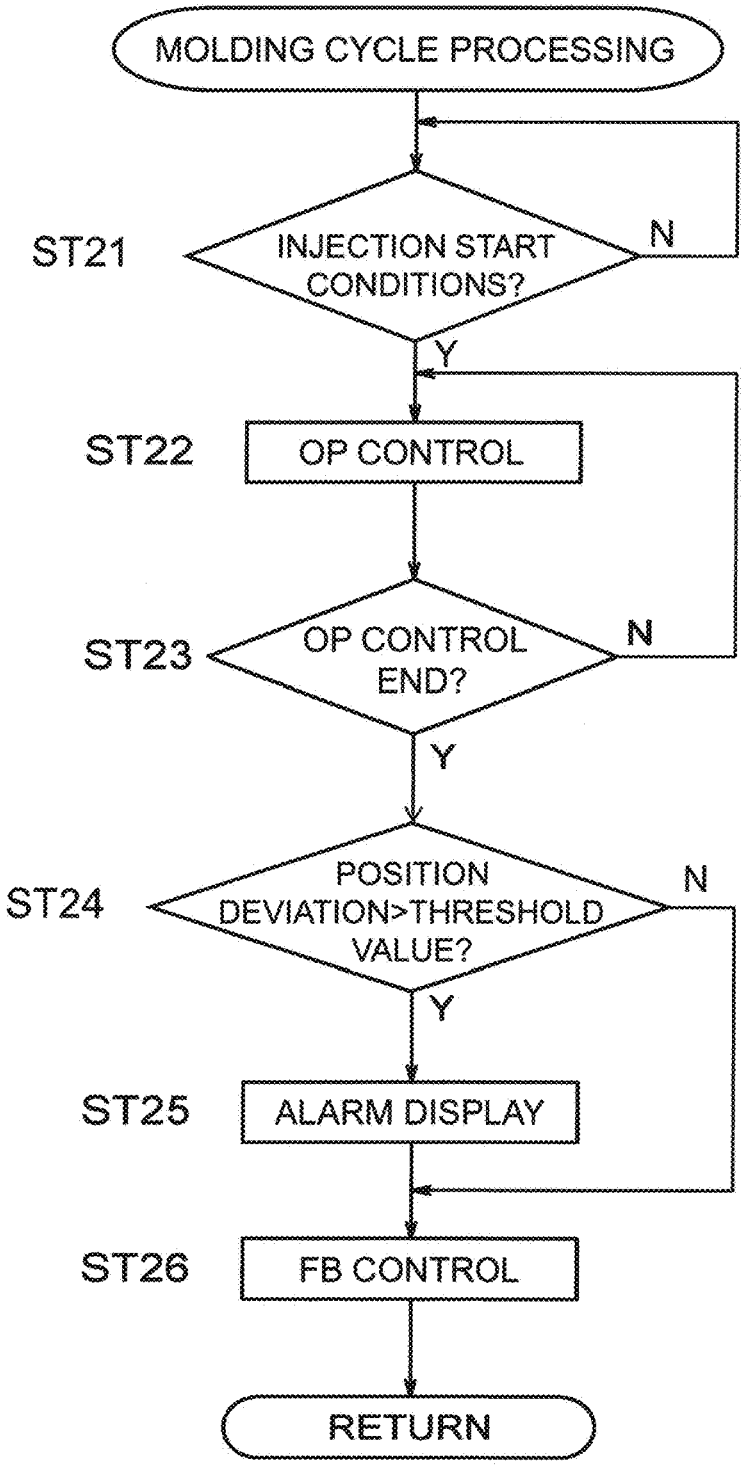
FIG. 13 is a flow chart showing an example of molding cycle processing which is performed at step ST6 in FIG. 11.

FIG. 13 is a flow chart showing an example of the molding cycle processing executed by the control device 11 at step ST6 in FIG. 11. Note, this chart shows only the routine relating to the velocity control in the routine of the molding cycle processing.

At step ST21, the control device 11 judges whether the predetermined injection start conditions are satisfied. Further, the control device 11 proceeds to step ST22 when yes, while stands by when no. The injection start condition is for example that the supply of molten metal to the sleeve 3 is completed by a not shown molten metal supply device.

At step ST22, the control device 11 performs open control of the injection velocity. That is, the control device 11 refers to the OP control-use table 51, specifies the command value Cv corresponding to the present elapsed time, and outputs the control command CS of that command value Cv to the flow rate control valve 29. Note that, the present elapsed time is the time count by the control device 11 using the time of the passage through step ST21 as the starting time.

At step ST23, the control device 11 judges whether the ending condition of the open control is satisfied. For example, the control device 11 judges whether the output of the control command CS is completed by the last time defined in the OP control-use table 51. Further, the control device 11 proceeds to step ST24 when yes, while returns to step ST22 and continues the open control when no.

At step ST24, the control device 11 calculates the difference dD between the detection position of the present plunger 5 and the target position of the present plunger 5. That is, the control device 11, as explained with reference to FIG. 9, calculates the difference dD at the time of ending the open control. Next, the control device 11 judges whether the difference dD exceeds the predetermined threshold value. Further, the control device 11 proceeds to step ST25 when yes, while skips step ST25 when no.

At step ST25, the control device 11 outputs a control command so as to make the display device 35 display a predetermined warning image.

At step ST26, the control device 11 performs feedback control of the flow rate control valve 29. That is, the control device 11 refers to the FB control-use table 53, specifies the target position corresponding to the present elapsed time, and outputs a control command CS in accordance with the deviation between that specified target position and the position detected by the position sensor 37.

Note that, the flow charts in FIG. 11 to FIG. 13 in the final analysis are for conceptually explaining the routine and may be suitably changed. Further, in actuality, parallel processing may be suitably carried out as well. For example, the processing for the alarm display at steps ST24 and ST25 may be executed parallel to the open control or feedback control or may be carried out after the feedback control ends based on the detection position acquired at the time of the end of open control.

In FIG. 11 to FIG. 13, step ST2 corresponds to the update-use control part 67 and information updating part 69. Step ST11 corresponds to the target velocity setting part 61. Steps ST12, ST13, and ST15 correspond to the target position calculation part 65. Steps ST12 to ST14 correspond to the command value setting part 63. Step ST22 corresponds to the OP control part 49. Steps ST24 and ST25 correspond to the display control part 71. Step ST26 corresponds to the FB control part 39.

As described above, in the present embodiment, the injection apparatus 1 has an injection cylinder 7 which can be connected to a plunger 5 capable of sliding inside a sleeve 3 communicated with the interior of a mold 101, a flow rate control valve 29 configuring a meter-out circuit of the injection cylinder 7 (or flow rate control valve 31 configuring the meter-in circuit), a position sensor 37 of detecting the position (and velocity) of the plunger 5, an input device 33 receiving an operation of the user, and a control device 11 which controls the flow rate control valve 29. The flow rate control valve 29 is an overlap type where the valve body (spool 45) is positioned at a position in accordance with a command value Cv of the input control command CS, the first port 47A is closed as it is even if the spool 45 moves at the time when the spool 45 is located in the predetermined overlapping range OR, and the first port 47A starts to be opened by the spool 45 passes through the overlapping range OR. The control device 11 has a memory unit 11*a* which holds characteristic information (characteristic table 55) linking the command value Cv of the control command CS to the flow rate control valve 29 and the velocity of the plunger 5 including also the movement of the plunger 5 which occurs due to the gap flow even if the spool 45 is in the overlapping range OR, a target velocity setting part 61 which sets the target velocity of the plunger 5 based on operation of the input device 33, a command value setting part 63 which sets the command value Cv of the control command CS for the open control of the flow rate control valve 29 at the time of start of injection by specifying the command value Cv of the control command CS to the flow rate control valve 29 corresponding to the target velocity set by the target velocity setting part 61 based on the characteristic table 55, an OP control part 49 which performs open control by outputting a control command CS of the command value Cv set by the command value setting part 63, and an FB control part 39 which performs feedback control of the flow rate control valve 29 so as to realize the target velocity set by the target velocity setting part 61 based on the detection value of the position sensor 37 after the open control.

Here, conventionally, irrespective of setting of the target velocity, the flow rate control valve 29 is opened so that the spool 45 passes through the overlapping range OR in a relatively short predetermined period. However, in the present embodiment, in accordance with setting of the target velocity, including also the state where the spool 45 is located in the overlapping range OR, the flow rate control valve 29 is suitably opened. As a result, the trackability of the actual injection velocity with respect to the target velocity is improved.

Further, in the present embodiment, the control device 11 further has the information updating part 69 which updates the characteristic table 55 based on a command value Cv of the control command CS and the velocity detected by the position sensor 37 at the time when that control command CS is output to the flow rate control valve 29.

Accordingly, for example, even if the flow rate characteristic of the flow rate control valve 29 changes along with time due to wear or the like, the command value for the open control can be suitably set. Further, it is possible to deal not only with such changes along with time, but also for example a situation where the flow rate characteristic of the flow rate control valve 29 ends up changing due to improvement/alteration of the hydraulic circuit of the die cast machine DC1 etc.

Further, in the present embodiment, the characteristic information linking the command value Cv of the control command CS to the flow rate control valve 29 and the velocity V of the plunger 5 is a table (characteristic table 55) linking the predetermined plurality of command values Cv and the plurality of velocities V of the plunger 5. The control device 11 further has an update-use control part 67 which outputs the control commands of the predetermined plurality of command values Cv in order, separately from the molding cycle. The information updating part 69 updates the velocities V linked with the plurality of command values Cv in the characteristic table 55 according to the velocities V detected by the position sensor 37 at the time when the control commands CS of the predetermined plurality of command values Cv are output in order from the update-use control part 67.

Accordingly, for example, the command values Cv held in the characteristic table 55 and the command values Cv in the measurement for generating the characteristic table 55 correspond to each other, therefore the velocity corresponding to the command value Cv can be correctly acquired. Consequently, the reliability of the characteristic table 55 is improved, and the velocity of the plunger 5 can easy track the target velocity.

Further, in the present embodiment, the sensor (position sensor 37) can detect the position of the plunger 5. The control device 11 has a target position calculation part 65 which calculates the target position of the plunger 5 for each elapsed time based on the target velocity set by the target velocity setting part 61. The FB control part 39 calculates the command value Cv for each elapsed time based on the sum of the value which is proportional to the deviation De between the position Dd of the plunger 5 detected by the position sensor 37 at that time and the target position Dt of the plunger 5 at that time and a predetermined offset value. Further, the FB control part 39 uses the last command value ($Ct_n$ in FIG. 7) in the open control as the offset value.

Accordingly, it becomes easy to suppress constant deviation, and the continuity of the velocity of the plunger at the transition from the open control to the feedback control is secured. As a result, the trackability of the velocity of the plunger 5 with respect to the target velocity is more improved.

Further, in the present embodiment, the injection apparatus 1 further has a display device 35 capable of displaying an image. The sensor (position sensor 37) can detect the position of the plunger 5. The command value setting part 63 sets the command value Cv of the control command CS to be output to the flow rate control valve 29 with respect to the elapsed time from the start of injection. The OP control part 49 outputs the control command CS of the command value Cv set by the command value setting part 63 based on the elapsed time from the start of injection. The control device 11 has a display control part 71 for making the display device 35 display a predetermined warning image when the difference dD (FIG. 9) between the position of the plunger 5 at the time of end of the open control calculated based on the target velocity set by the target velocity setting part 61 and the position of the plunger 5 detected by the position sensor 37 at the time of end of the open control exceeds a predetermined threshold value.

Accordingly, as already explained, the operator can learn the timing at which the characteristic table 55 should be updated. As a result, a change along with time of the flow rate control valve 29 and so on can be coped with at an early stage before production of large number of defective products. Further, since the quality is judged based on the calculated position (target position) and the detected position at the time of end of the open control, the quality ends up being judged based on the result at the time having a high probability of the largest error, therefore the reliability of the result of judgment is high though the comparison is carried out at one time.

Further, in the present embodiment, the sensor (position sensor 37) can detect the position of the plunger 5. The OP control part 49 and FB control part 39 control the flow rate control valve 29 so as to switch from open control to feedback control at the time when a constant velocity is reached in a case where the target velocity of the plunger 5 set by the target velocity setting part 61 rises to the constant velocity (low injection velocity $V_L$) from the start of injection, then that constant velocity is maintained.

Usually, such a first constant velocity after the start of injection (low injection velocity $V_L$) is a relatively low velocity and is sufficiently high compared with the velocity of the plunger 5 ($V_{OL}$ in FIG. 5) at the time when the spool 45 passes through the overlapping range OR. Accordingly, by switching from the open control to the feedback control at the time when such a velocity (low injection velocity $V_L$) is reached, for example, the inconvenience of the feedback control being executed in the overlapping range OR or unnecessarily long open control being executed hardly ever occurs. That is, the velocity control is preferably carried out as a whole.

Modification

Figure 14:
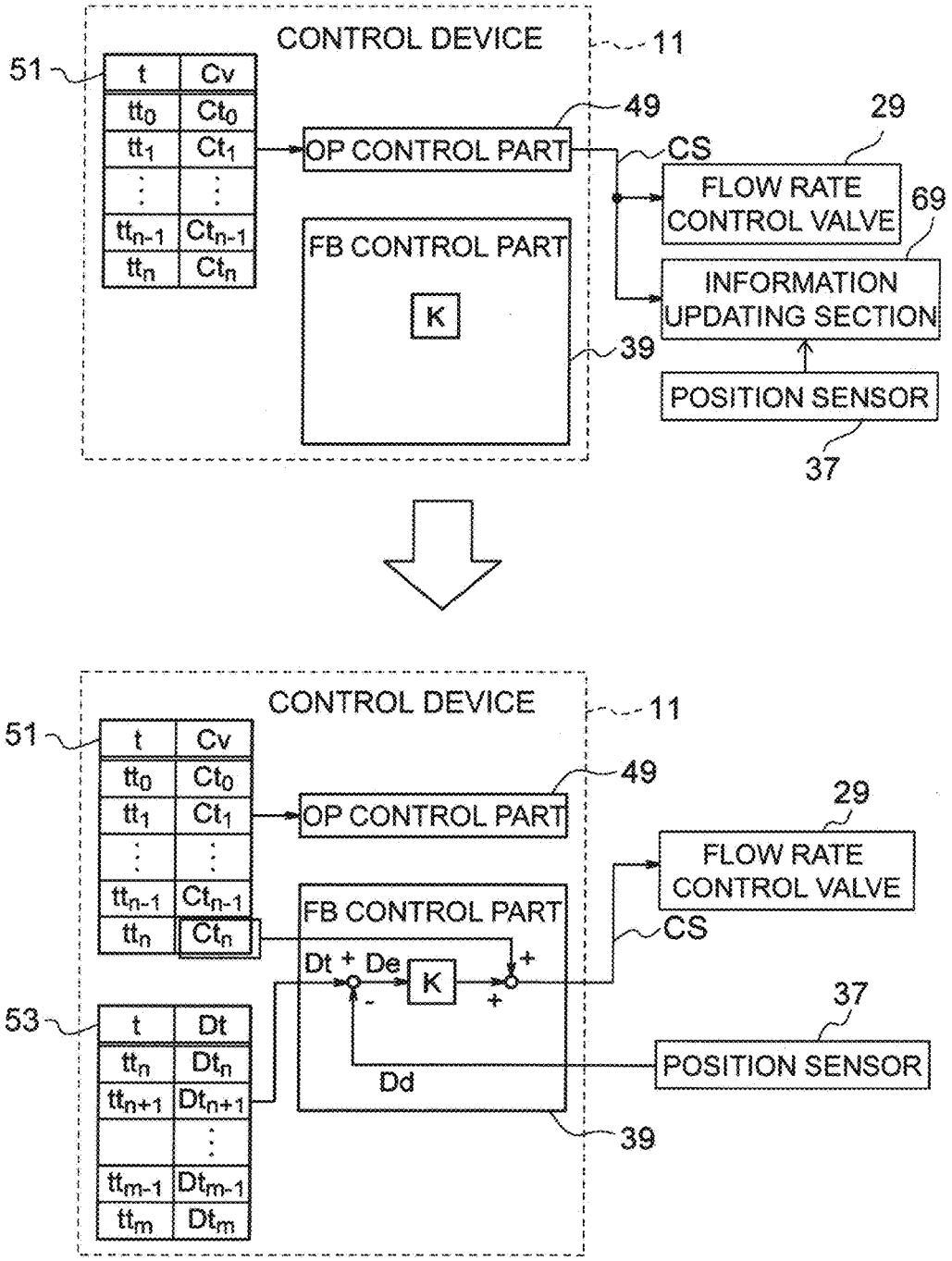
FIG. 14 is a schematic view for explaining the operation of a control device according to a modification.

FIG. 14 is a diagram for explaining the operation of the control device 11 according to a modification and corresponds to FIG. 7.

In the above embodiment, the measurement for updating (generating) the characteristic table 55 was carried out separately from the molding cycle. On the other hand, in the modification, the measurement for updating the characteristic table 55 is carried out during the molding cycle.

For example, as shown on the upper side of the drawing sheet in FIG. 14, in the molding cycle, when the control command CS is output from the OP control part 49 to the flow rate control valve 29 and the open control at the time of start of injection is carried out, the information updating part 69 acquires the command value Cv of the control command CS and the velocity detected by the position sensor 37 and links the ones at the same time (or the velocities at the time delayed a little with respect to the command value Cv). Further, due to this, updating of the characteristic table 55 becomes possible.

When the command value Cv of the control command CS output from the OP control part 49 does not coincide with the command value Cv held in the characteristic table 55, interpolation and/or extrapolation may be suitably carried out with respect to the plural sets of data of command values Cv and detection velocities which are acquired during the open control to update the velocities in the characteristic table 55. Further, it is possible to update the velocities in the characteristic table 55 including the command values Cv held in the characteristic table 55 according to the acquired plural sets of data of command values Cv and detection velocities.

In the above embodiment, the die cast machine DC1 is one example of the molding machine. The position sensor 37 is one example of the sensor. The spool 45 is one example of the valve body. The first port 47A is one example of the port. The characteristic table 55 is one example of the characteristic information and table. The OP control part 49 is one example of the open control part. The FB control part 39 is one example of the feedback control part.

The present invention is not limited to the above embodiment and may be executed in various ways.

The molding machine is not limited to the die cast machine. For example, the molding machine may be another metal molding machine, may be an injection molding machine for molding a resin, or may be a molding machine for molding a material obtained by mixing a thermoplastic resin or the like with sawdust. Further, the injection apparatus is not limited to horizontal clamping/horizontal injection and may for example use vertical clamping/vertical injection, horizontal clamping/vertical injection, or vertical clamping/horizontal injection.

The overlap type flow rate control valve is not limited to a spool type. For example, it may be a sliding valve in which the valve body rotates around an axis as well.

The characteristic information linking the command value of the control command to the flow rate control valve and the velocity of the plunger is not limited to a table linking the plurality of command values and the plurality of velocities. For example, the characteristic information may be a formula calculating a command value from the velocity as well. Further, the characteristic information need not be one directly linking the command value and the velocity, but for example may be comprised of information linking the command value and the flow rate in the flow rate control valve and information linking the flow rate and the velocity of the plunger.

The configuration for realizing the function of updating the characteristic information, the function of using the last command value of the open control as the offset value, the function of judging the quality of the control result, and/or the alarm display function based on the judgment result need not be provided either. Even if such functions do not exist, control considering the overlap characteristic is still carried out.

In the embodiment, the injection velocity was set with respect to the position of the plunger through the input device. However, the injection velocity may be set with respect to the elapsed time through the input device as well. Further, in the embodiment, the velocity feedback control was substantially carried out by directly performing the position feedback control. However, velocity feedback control may be carried out as well based on the deviation of the velocity itself.

In the embodiment, the position (time) at which the injection velocity reaches the first constant velocity (low injection velocity) was determined as the switching position of switching from the open control to the feedback control. However, the switching position may be another position as well.

Further, the switching position may be determined to for example a position at which the valve body has passed through the overlapping range and separates from the overlapping range by a predetermined amount. That is, the switching position need not be set based on the set target velocity. The switching position may be set based on the flow rate characteristic of the valve body. Note that, in the embodiment, the data corresponding to the period from the start of injection to the switching position was extracted from the target position table Tb2 by referring to the target position Dt held in the target position table Tb2. As described above, when setting the switching position using the overlapping range as a reference, for example, the OP control-use table 51 may be generated by preparing the table linking the elapsed time and the command value in the same way as the embodiment except for extracting the data from the target position table Tb2, then extracting the range until the command value reaches a value set in advance (value corresponding to the end of the open control). Further, the FB control-use table 53 may be extracted from the target position table Tb2 based on the elapsed time at the time when the command value reaches the value set in advance in the OP control-use table 51.

The judgment of quality of the result of control is not limited to one based on the position at the time when the open control ends. For example, the error from the start of injection to the end of the open control may be continuously acquired, and the judgment may be carried out using the maximum value among them as well.

Priority is claimed on Japanese application No. 2016-75608, filed on Apr. 5, 2016, the content of which is incorporated herein by reference.

REFERENCE SIGNS LIST

1 . . . injection apparatus, 3 . . . sleeve, 5 . . . plunger, 7 . . . injection cylinder, 11 . . . control device, 11*a* . . . memory unit, 29 . . . flow rate control valve, 33 . . . input device, 37 . . . position sensor (sensor), 39 . . . FB control part (feedback control part), 45 . . . spool, 49 . . . OP control part (open control part), 47A . . . first port, 55 . . . characteristic table (characteristic information), 61 . . . target velocity setting part, and 63 . . . command value setting part.

The invention claimed is:

1. An injection apparatus comprising:

an injection cylinder connected to a plunger capable of sliding in a sleeve communicated with an inside of a mold, a flow rate control valve which configures a meter-in circuit or meter-out circuit of the injection cylinder, a sensor which detects at least one of a position or a velocity of the plunger, an input device which accepts an operation of a user, and a control device which controls the flow rate control valve, wherein the flow rate control valve comprises a valve main body comprising a port and a valve body sliding with respect to the valve main body, where the valve body is positioned at a position in accordance with a command value of an input control command, the port is closed as it is at a time when the valve body is positioned in a predetermined overlapping range even if the valve body moves, the port starts to be opened by the valve body passing through the overlapping range, and a gap flow where hydraulic fluid flows through a gap between the valve main body and the valve body to the port regardless of whether the valve body is positioned in the overlapping range, and the control device comprises a memory unit which holds characteristic information linking the command value of the control command to the flow rate control valve and the velocity of the plunger including a movement of the plunger which is caused by the gap flow regardless of whether the valve body is positioned in the overlapping range, a target velocity setting part for setting a target velocity of the plunger based on operation of the input device, a command value setting part which sets the command value of the control command for open control of the flow rate control valve at the time of start of injection by specifying the command value of the control command to the flow rate control valve corresponding to the target velocity set by the target velocity setting part based on the characteristic information, an open control part which outputs a control command having a command value set by the command value setting part and performs open control, and a feedback control part which performs feedback control of the flow rate control valve so that the target velocity set by the target velocity setting part is realized based on a detection value of the sensor after the open control.

2. The injection apparatus according to claim 1, wherein the control device further comprises an information updating part which updates the characteristic information based on the command value of the control command and the velocity detected by the sensor at the time when the control command is output to the flow rate control valve.

3. The injection apparatus according to claim 2, wherein the characteristic information is a table linking a predetermined plurality of command values and a plurality of velocities of the plunger, the control device further comprises an update-use control part which, separately from the molding cycle, outputs the control commands of the predetermined plurality of command values in order, and the information updating part updates the velocities linked with the predetermined plurality of command values in the table according to the velocity detected by the sensor at the time when the control commands having the predetermined plurality of command values are output in order from the update-use control part.

4. The injection apparatus according to claim 2, wherein the information updating part updates the characteristic information based on the command value of the control command and the velocity detected by the sensor at the time when this control command is output to the flow rate control valve in the molding cycle.

5. The injection apparatus according to claim 1, wherein the sensor is able to detect the position of the plunger, the control device comprises a target position calculation part which calculates the target position of the plunger for each elapsed time based on the target velocity set by the target velocity setting part, and the feedback control part calculates the command value for each elapsed time based on a sum of a value proportional to a deviation between the position of the plunger detected by the sensor at that time and the target position of the plunger at that time and the predetermined offset value and uses the last command value in the open control as the offset value.

6. The injection apparatus according to claim 1, further comprising a display device capable of displaying an image, wherein the sensor detects the position of the plunger, the command value setting part sets the command value of the control command for the open control with respect to the elapsed time from the start of injection, the open control part outputs the control command of the command value set by the command value setting part based on the elapsed time from the start of injection, and the control device comprises a display control part which makes the display device display a predetermined alert image at the time when a difference between the position of the plunger at the time of end of the open control which is calculated based on the target velocity set by the target velocity setting part and the position of the plunger detected by the sensor at the time of end of the open control exceeds a predetermined threshold value.

7. The injection apparatus according to claim 1, wherein the open control part and the feedback control part control the flow rate control valve so as to switch from the open control to the feedback control at the time when the velocity of the plunger reaches a constant level in a case where the target velocity of the plunger set by the target velocity setting part rises to the constant velocity from the start of injection, then the constant velocity is maintained.

8. A molding machine having an injection apparatus according to claim 1.

* * * * *